US011959667B2

(12) United States Patent
Iwata et al.

(10) Patent No.: US 11,959,667 B2
(45) Date of Patent: Apr. 16, 2024

(54) REFRIGERATION CYCLE DEVICE

(71) Applicant: DAIKIN INDUSTRIES, LTD., Osaka (JP)

(72) Inventors: Ikuhiro Iwata, Osaka (JP); Eiji Kumakura, Osaka (JP); Kazuhiro Furusho, Osaka (JP); Ryusuke Fujiyoshi, Osaka (JP); Hiromune Matsuoka, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 372 days.

(21) Appl. No.: 17/280,672

(22) PCT Filed: Sep. 27, 2019

(86) PCT No.: PCT/JP2019/038399
§ 371 (c)(1),
(2) Date: Mar. 26, 2021

(87) PCT Pub. No.: WO2020/071293
PCT Pub. Date: Apr. 9, 2020

(65) Prior Publication Data

US 2022/0003461 A1 Jan. 6, 2022

(30) Foreign Application Priority Data

Oct. 2, 2018 (JP) ..... 2018-187366

(51) Int. Cl.
*F25B 1/10* (2006.01)
*F25B 40/02* (2006.01)
*F25B 49/02* (2006.01)

(52) U.S. Cl.
CPC ..... *F25B 1/10* (2013.01); *F25B 40/02* (2013.01); *F25B 49/022* (2013.01); (Continued)

(58) Field of Classification Search
CPC ..... F25B 1/10; F25B 40/02; F25B 49/022; F25B 2313/0233; F25B 2313/0253; F25B 2313/0314; F25B 2313/0315
See application file for complete search history.

(56) References Cited

U.S. PATENT DOCUMENTS

2010/0251741 A1* 10/2010 Yoshimi ..... F25B 1/10 62/324.5
2015/0075199 A1 3/2015 Kotani et al.
2016/0265814 A1* 9/2016 Pfister ..... F25B 39/04

FOREIGN PATENT DOCUMENTS

JP 2009036508 A * 2/2009
JP 2012-207835 A 10/2012
(Continued)

OTHER PUBLICATIONS

Sasaki et al., Supercooling System, Feb. 19, 2009, JP2009036508A, Whole Document (Year: 2009).*
(Continued)

*Primary Examiner* — Larry L Furdge
(74) *Attorney, Agent, or Firm* — Birch, Stewart, Kolasch & Birch, LLP

(57) ABSTRACT

A suction injection pipe and a subcooling heat exchanger are provided at a main refrigerant circuit in which a main refrigerant circulates. Further, a sub-refrigerant circuit that differs from the main refrigerant circuit and in which a sub-refrigerant circulates is provided. A controller performs control for switching between a cooling action of the sub-cooling heat-exchanger that cools the main refrigerant that is sent to a main use-side heat exchanger by using the suction injection pipe and the subcooling heat exchanger, and a cooling action of the sub-refrigerant-circuit that cools the main refrigerant that is sent to the main use-side heat exchanger by using the sub-refrigerant circuit.

20 Claims, 11 Drawing Sheets

(52) U.S. Cl.
CPC ..... *F25B 2313/0233* (2013.01); *F25B 2313/0253* (2013.01); *F25B 2313/0314* (2013.01); *F25B 2313/0315* (2013.01)

(56) References Cited

FOREIGN PATENT DOCUMENTS

| | | |
|---|---|---|
| JP | 2013-139938 A | 7/2013 |
| JP | 2016-169911 A | 9/2016 |

OTHER PUBLICATIONS

International Preliminary Report on Patentability and English translation of the Written Opinion of the International Searching Authority for International Application No. PCT/JP2019/038399, dated Apr. 15, 2021.
International Search Report (PCT/ISA/210) issued in PCT/JP2019/038399, dated Nov. 26, 2019.
Extended European Search Report for European Application No. 19869332.7, dated Oct. 15, 2021.

* cited by examiner

REFRIGERATION CYCLE DEVICE

TECHNICAL FIELD

The present disclosure relates to a refrigeration cycle device in which a suction injection pipe and a subcooling heat exchanger are provided at a refrigerant circuit having a compressor, a heat-source-side heat exchanger, an expansion mechanism, and a use-side heat exchanger, the suction injection pipe causing a refrigerant that flows between the heat-source-side heat exchanger and the use-side heat exchanger to branch off and to be sent to a suction side of the compressor, the subcooling heat exchanger cooling a refrigerant that flows between the expansion mechanism and the use-side heat exchanger by heat exchange with a refrigerant that flows in the suction injection pipe.

BACKGROUND ART

Hitherto, there has existed a refrigeration cycle device that includes a refrigerant circuit having a compressor, a heat-source-side heat exchanger, an expansion mechanism, and a use-side heat exchanger. As such a refrigeration cycle device, as described in Patent Literature 1 (Japanese Unexamined Patent Application Publication No. 2013-139938), there exists a device in which a suction injection pipe and a subcooling heat exchanger are provided at a refrigerant circuit, the suction injection pipe causing a refrigerant that flows between the heat-source-side heat exchanger and the use-side heat exchanger to branch off and to be sent to a suction side of the compressor, the subcooling heat exchanger cooling a refrigerant that flows between the expansion mechanism and the use-side heat exchanger by heat exchange with a refrigerant that flows in the suction injection pipe.

SUMMARY OF INVENTION

Technical Problem

Since the suction injection pipe and the subcooling heat exchanger are provided at the refrigerant circuit, the refrigeration cycle device known in the related art above can perform an action (a cooling action of the subcooling heat-exchanger) that cools a refrigerant that flows between the expansion mechanism and the use-side heat exchanger with a refrigerant that branches off from a location between the heat-source-side heat exchanger and the use-side heat exchanger and that is sent to the suction side of the compressor. By performing the cooling action of the subcooling heat-exchanger, the enthalpy of a refrigerant that is sent to the use-side heat exchanger is reduced, and the heat exchange capacity that is obtained by evaporation of the refrigerant at the use-side heat exchanger (evaporation capacity of the use-side heat exchanger) can be increased.

However, depending upon operating conditions, such as outside air temperature, it may be difficult to increase the evaporation capacity of the use-side heat exchanger.

Therefore, in the refrigeration cycle device in which the suction injection pipe and the subcooling heat exchanger are provided at the refrigerant circuit, it is desirable that the evaporation capacity of the use-side heat exchanger be capable of being increased regardless of the operating conditions.

Solution to Problem

A refrigeration cycle device according to a first aspect includes a main refrigerant circuit, a sub-refrigerant circuit, and a control unit that controls constituent devices of the main refrigerant circuit and the sub-refrigerant circuit. The main refrigerant circuit has a main compressor, a main heat-source-side heat exchanger, a main use-side heat exchanger, a main expansion mechanism, a suction injection pipe, and a subcooling heat exchanger. The main compressor is a compressor that compresses a main refrigerant. The main heat-source-side heat exchanger is a heat exchanger that functions as a heat dissipater (a radiator) of the main refrigerant. The main use-side heat exchanger is a heat exchanger that functions as an evaporator of the main refrigerant. The main expansion mechanism is an expansion mechanism that decompresses the main refrigerant that flows between the main heat-source-side heat exchanger and the main use-side heat exchanger. The suction injection pipe is a refrigerant pipe that causes the main refrigerant that flows between the main heat-source-side heat exchanger and the main use-side heat exchanger to branch off and to be sent to a suction side of the main compressor. The subcooling heat exchanger is a heat exchanger that cools the main refrigerant that flows between the main expansion mechanism and the main use-side heat exchanger by heat exchange with the main refrigerant that flows in the suction injection pipe. The main refrigerant circuit has a sub-use-side heat exchanger that functions as a cooler of the main refrigerant that flows between the main expansion mechanism and the main use-side heat exchanger. The sub-refrigerant circuit has a sub-compressor, a sub-heat-source-side heat exchanger, and the sub-use-side heat exchanger. The sub-compressor is a compressor that compresses the sub-refrigerant. The sub-heat-source-side heat exchanger is a heat exchanger that functions as a heat dissipater of the sub-refrigerant. The sub-use-side heat exchanger is a heat exchanger that functions as an evaporator of the sub-refrigerant and that cools the main refrigerant that flows between the main expansion mechanism and the main use-side heat exchanger. In addition, in accordance with outside air temperature, a temperature of the main refrigerant at the main heat-source-side heat exchanger, a subcooling degree of the main refrigerant at an outlet of the subcooling heat exchanger, or a subcooling degree of the main refrigerant at an outlet of the sub-use-side heat exchanger, the control unit switches between a cooling action of the subcooling heat-exchanger that cools the main refrigerant by using the suction injection pipe and the subcooling heat exchanger and a cooling action of the sub-refrigerant-circuit that cools the main refrigerant by using the sub-refrigerant circuit.

Here, as described above, not only are the suction injection pipe and the subcooling heat exchanger that are the same as those known in the art provided at the main refrigerant circuit in which the main refrigerant circulates, but also the sub-refrigerant circuit that differs from the main refrigerant circuit and in which the sub-refrigerant circulates is provided. In addition, the sub-use-side heat exchanger that is provided at the sub-refrigerant circuit and that functions as an evaporator of the sub-refrigerant is provided at the main refrigerant circuit so as to function as a heat exchanger that cools the main refrigerant that flows between the main expansion mechanism and the main use-side heat exchanger. Therefore, here, not only can be performed the cooling action of the subcooling heat-exchanger that cools the main refrigerant that flows between the main expansion mechanism and the main use-side heat exchanger by using the suction injection pipe and the subcooling heat exchanger that are the same as those known in the art, but also the cooling action of the sub-refrigerant-circuit that cools the main refrigerant that flows between the main expansion mechanism and the main use-side heat exchanger by using the sub-refrigerant circuit can be performed. In addition, here, as described above, even if the enthalpy of the main refrigerant that is sent to the main use-side heat exchanger is not sufficiently reduced in the cooling action of the subcooling heat-exchanger, as a result of switching between the cooling action of the subcooling heat-exchanger and the cooling action of the sub-refrigerant-circuit in accordance with a state quantity, such as outside air temperature, it is possible to sufficiently reduce the enthalpy of the main refrigerant that is sent to the main use-side heat exchanger by the cooling action of the sub-refrigerant-circuit. Thus, it is possible to increase the evaporation capacity of the main use-side heat exchanger.

In this way, here, in the refrigeration cycle device in which the suction injection pipe and the subcooling heat exchanger are provided at the refrigerant circuit, it is possible to increase the evaporation capacity of the use-side heat exchanger regardless of operating conditions.

A refrigeration cycle device according to a second aspect is the refrigeration cycle device according to the first aspect, in which, in a predetermined case, the control unit performs the cooling action of the sub-refrigerant-circuit among the cooling action of the sub-refrigerant-circuit and the cooling action of the subcooling heat-exchanger.

Here, the predetermined case is when the outside air temperature is greater than or equal to a first temperature, when the temperature of the main refrigerant at the main heat-source-side heat exchanger is greater than or equal to a second temperature, when the subcooling degree of the main refrigerant at the outlet of the subcooling heat exchanger is less than or equal to a first subcooling degree, or when the subcooling degree of the main refrigerant at the outlet of the sub-use-side heat exchanger is less than or equal to a second subcooling degree.

Here, as described above, the condition of a state quantity, such as outside air temperature, for performing only the cooling action of the sub-refrigerant-circuit is prescribed. Here, when, due to, for example, an increase in outside air temperature, the enthalpy of the main refrigerant that is sent to the main use-side heat exchanger becomes difficult to reduce even if the cooling action of the subcooling heat-exchanger is performed, the coefficient of performance of the refrigeration cycle device tends to be reduced. In addition, when this tendency is increased, reducing the enthalpy of the main refrigerant that is sent to the main use-side heat exchanger by the cooling action of the sub-refrigerant-circuit rather realizes the condition of increasing the coefficient of performance of the refrigeration cycle device even when consumption energy of the sub-compressor is considered. Therefore, here, the condition in which the cooling action of the sub-refrigerant-circuit increases the coefficient of performance of the refrigeration cycle device greater than the cooling action of the subcooling heat-exchanger is prescribed, as described above, as the first temperature, the second temperature, the first subcooling degree, or the second subcooling degree.

Consequently, here, it is possible to switch to perform only the cooling action of the sub-refrigerant-circuit by considering the coefficient of performance of the refrigeration cycle device.

A refrigeration cycle device according to a third aspect is the refrigeration cycle device according to the first aspect or the second aspect, in which, in a predetermined case, the cooling action of the subcooling heat-exchanger is performed among the cooling action of the sub-refrigerant-circuit and the cooling action of the subcooling heat-exchanger. Here, the predetermined case is when the outside air temperature is less than or equal to a third temperature, when the temperature of the main refrigerant at the main heat-source-side heat exchanger is less than or equal to a fourth temperature, when the subcooling degree of the main refrigerant at the outlet of the subcooling heat exchanger is greater than or equal to a third subcooling degree, or when the subcooling degree of the main refrigerant at the outlet of the sub-use-side heat exchanger is greater than or equal to a fourth subcooling degree.

Here, as described above, the condition of a state quantity, such as outside air temperature, for performing only the cooling action of the subcooling heat-exchanger is prescribed. Here, when, due to, for example, a reduction in outside air temperature, the enthalpy of the main refrigerant that is sent to the main use-side heat exchanger is sufficiently reduced by performing the cooling action of the subcooling heat-exchanger, the coefficient of performance of the refrigeration cycle device has a tendency to increase. In addition, when this tendency is increased, reducing the enthalpy of the main refrigerant that is sent to the main use-side heat exchanger by performing the cooling action of the sub-refrigerant-circuit rather realizes the condition of reducing the coefficient of performance of the refrigeration cycle device when consumption energy of the sub-compressor is considered. Therefore, here, the condition in which the cooling action of the subcooling heat-exchanger increases the coefficient of performance of the refrigeration cycle device greater than the cooling action of the sub-refrigerant-circuit is prescribed, as described above, as the third temperature, the fourth temperature, the third subcooling degree, or the fourth subcooling degree.

Consequently, here, it is possible to switch to perform only the cooling action of the subcooling heat-exchanger by considering the coefficient of performance of the refrigeration cycle device.

A refrigeration cycle device according to a fourth aspect is the refrigeration cycle device according to any one of the first aspect to the third aspect, in which the control unit performs the cooling action of the sub-refrigerant-circuit by operating the sub-compressor, and stops the cooling action of the sub-refrigerant-circuit by stopping the sub-compressor.

A refrigeration cycle device according to a fifth aspect is the refrigeration cycle device according to the fourth aspect, in which, at a time of the cooling action of the sub-refrigerant-circuit, the control unit controls an operating capacity of the sub-compressor.

Therefore, here, at the time of the cooling action of the sub-refrigerant-circuit, it is possible to adjust the cooling capacity of the sub-use-side heat exchanger by changing the flow rate of the sub-refrigerant that circulates in the sub-refrigerant circuit.

A refrigeration cycle device according to a sixth aspect is the refrigeration cycle device according to the first aspect to the fifth aspect, in which the suction injection pipe has a suction injection expansion mechanism. In addition, the control unit performs the cooling action of the subcooling heat-exchanger by opening the suction injection expansion mechanism, and stops the cooling action of the subcooling heat-exchanger by closing the suction injection expansion mechanism.

A refrigeration cycle device according to a seventh aspect is the refrigeration cycle device according to the sixth aspect, in which, at a time of the cooling action of the subcooling heat-exchanger, the control unit controls an opening degree of the suction injection expansion mechanism.

Therefore, here, at the time of the cooling action of the subcooling heat-exchanger, it is possible to adjust the cooling capacity of the subcooling heat exchanger by changing the flow rate of the main refrigerant that flows in the suction injection pipe.

A refrigeration cycle device according to an eighth aspect is the refrigeration cycle device according to the sixth aspect or the seventh aspect, in which the main refrigerant circuit has a gas-liquid separator between the main expansion mechanism and the subcooling heat exchanger, the gas-liquid separator causing the main refrigerant decompressed at the main expansion mechanism to undergo a gas-liquid separation. A degassing pipe that extracts the main refrigerant in a gas state and sends the main refrigerant in the gas state to the suction side of the main compressor is connected to the gas-liquid separator. The suction injection pipe is provided at the main refrigerant circuit so that the main refrigerant in a liquid state that flows between the gas-liquid separator and the subcooling heat exchanger branches off. The subcooling heat exchanger is provided at the main refrigerant circuit so that the main refrigerant in the liquid state that flows between the gas-liquid separator and the main use-side heat exchanger is cooled by heat exchange with the main refrigerant that flows in the suction injection pipe and the main refrigerant that flows in the degassing pipe.

Here, as described above, the suction injection pipe causes the main refrigerant in the liquid state that flows between the gas-liquid separator and the subcooling heat exchanger to branch off, and the subcooling heat exchanger is provided between the gas-liquid separator and the main use-side heat exchanger. In addition, it is possible to cause, not only the main refrigerant that flows in the suction injection pipe, but also a main refrigerant that is extracted by the degassing pipe from the gas-liquid separator to flow to the subcooling heat exchanger as a main-refrigerant cooling source. Therefore, here, at the time of the cooling action of the subcooling heat-exchanger, a main refrigerant that flows in the suction injection pipe and the degassing pipe is caused to flow in the subcooling heat exchanger by an opening action of the suction injection expansion mechanism, and, when the cooling action of the subcooling heat-exchanger is stopped, only the main refrigerant that flows in the degassing pipe is caused to flow in the subcooling heat exchanger by a closing operation of the suction injection expansion mechanism.

In this way, here, when the cooling action of the subcooling heat-exchanger is performed and when the cooling action of the subcooling heat-exchanger is stopped, the subcooling heat exchanger allows the main refrigerant in the liquid state that flows between the gas-liquid separator and the main use-side heat exchanger to be cooled by at least the main refrigerant that flows in the degassing pipe.

A refrigeration cycle device according to a ninth aspect is the refrigeration cycle device according to any one of the first aspect to the eighth aspect, in which the main refrigerant is carbon dioxide, and in which the sub-refrigerant is a HFC refrigerant, a HFO refrigerant, or a mixture refrigerant in which the HFC refrigerant and the HFO refrigerant are mixed, the HFC refrigerant, the HFO refrigerant, and the mixture refrigerant having a GWP (global warming coefficient) that is 750 or less.

Here, as described above, since the main refrigerant and the sub-refrigerant having a low GWP are used, it is possible to reduce environmental load, such as global warming.

A refrigeration cycle device according to a tenth aspect is the refrigeration cycle device according to any one of the first aspect to the eighth aspect, in which the main refrigerant is carbon dioxide, and in which the sub-refrigerant is a natural refrigerant having a coefficient of performance that is higher than a coefficient of performance of the carbon dioxide.

Here, as described above, since, as the sub-refrigerant, a natural refrigerant having a coefficient of performance that is higher than that of carbon dioxide is used, it is possible to reduce environmental load, such as global warming.

DESCRIPTION OF EMBODIMENTS

A refrigeration cycle device is described below based on the drawings.

(1) Configuration

Figure 1:
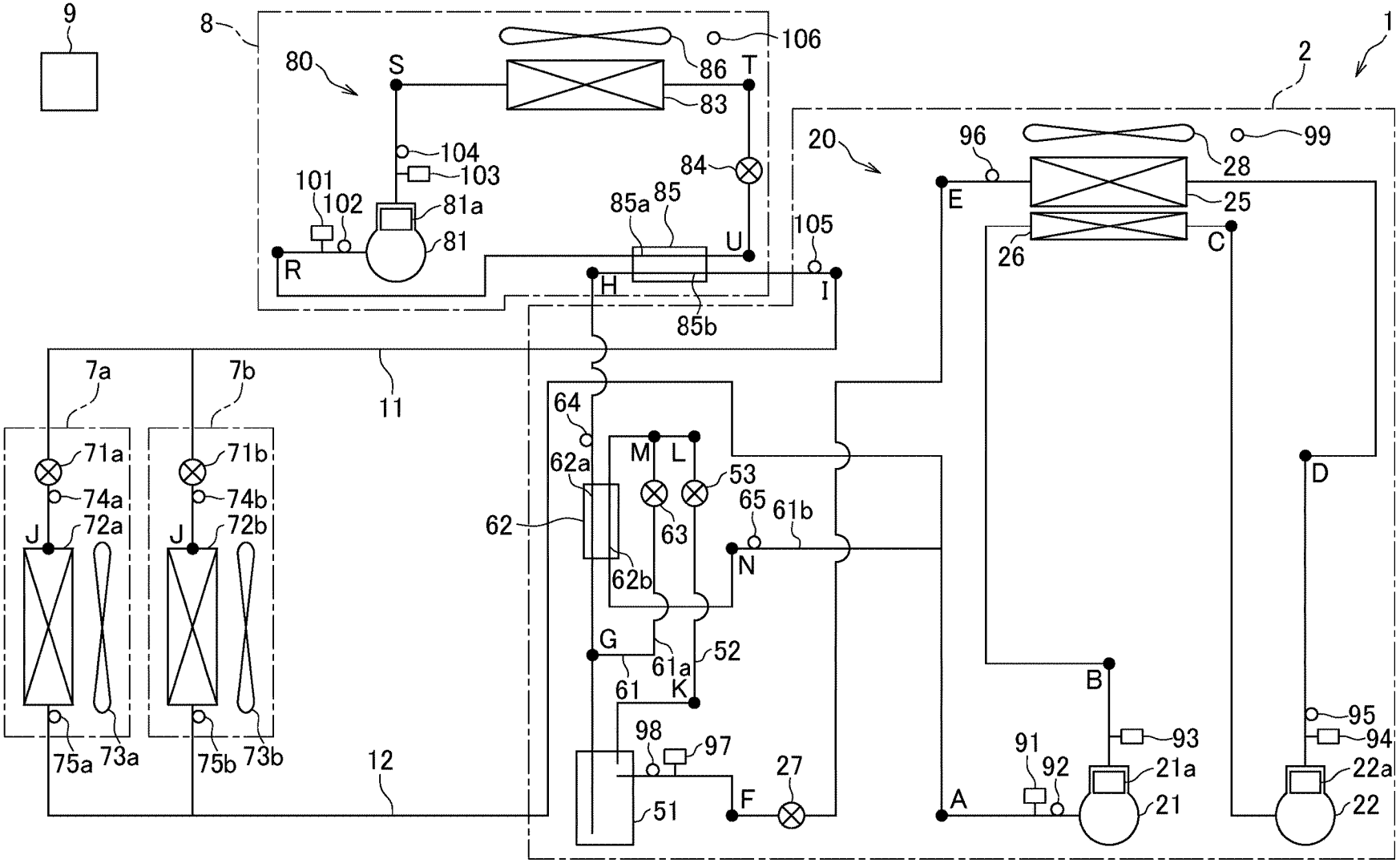
FIG. 1 is a schematic view of a configuration of a refrigeration cycle device according to an embodiment of the present disclosure.

FIG. 1 is a schematic view of a configuration of a refrigeration cycle device 1 according to an embodiment of the present disclosure.

<Circuit Configuration>

The refrigeration cycle device 1 includes a main refrigerant circuit 20 in which a main refrigerant circulates and a sub-refrigerant circuit 80 in which a sub-refrigerant circulates, and is a device that air-conditions (here, cools) the interior of a room.

—Main Refrigerant Circuit—

The main refrigerant circuit 20 primarily has main compressors 21 and 22, a main heat-source-side heat exchanger 25, main use-side heat exchangers 72*a* and 72*b*, a main expansion mechanism 27, a suction injection pipe 61, a subcooling heat exchanger 62, and a sub-use-side heat exchanger 85. The main refrigerant circuit 20 has an intermediate heat exchanger 26, a gas-liquid separator 51, a degassing pipe 52, and main use-side expansion mechanisms 71*a* and 71*b*. As the main refrigerant, carbon dioxide is sealed in the main refrigerant circuit 20.

The main compressors 21 and 22 are devices that compress the main refrigerant. The first main compressor 21 is a compressor in which a low-stage-side compression element 21*a*, such as a rotary type or a scroll type, is driven by a driving mechanism, such as a motor or an engine.

The second main compressor 22 is a compressor in which a high-stage-side compression element 22*a*, such as a rotary type or a scroll type, is driven by a driving mechanism, such as a motor or an engine. The main compressors 21 and 22 constitute a multi-stage compressor (here, a two-stage compressor) in which, at the first main compressor 21 on the low-stage side, the main refrigerant is compressed and then discharged, and in which, at the second main compressor 22 on the high-stage side, the main refrigerant discharged from the first main compressor 21 is compressed.

The intermediate heat exchanger 26 is a device that causes the main refrigerant and outdoor air to exchange heat with each other, and, here, is a heat exchanger that functions as a cooler of a main refrigerant that flows between the first main compressor 21 and the second main compressor 22.

The main heat-source-side heat exchanger 25 is a device that causes the main refrigerant and outdoor air to exchange heat with other, and, here, is a heat exchanger that functions as a heat dissipater (a radiator) of the main refrigerant. One end (inlet) of the main heat-source-side heat exchanger 25 is connected to a discharge side of the second main compressor 22, and the other end (outlet) of the main heat-source-side heat exchanger 25 is connected to the main expansion mechanism 27.

The main expansion mechanism 27 is a device that decompresses the main refrigerant, and, here, is an expansion mechanism that decompresses a main refrigerant that flows between the main heat-source-side heat exchanger 25 and the main use-side heat exchangers 72*a* and 72*b*. Specifically, the main expansion mechanism 27 is provided between the other end (outlet) of the main heat-source-side heat exchanger 25 and the gas-liquid separator 51. The main expansion mechanism 27 is, for example, an electrically powered expansion valve. Note that the main expansion mechanism 27 may be an expander that causes power to be produced by decompressing the main refrigerant.

The gas-liquid separator 51 is a device that causes the main refrigerant to undergo gas-liquid separation, and, here, is a container at which the main refrigerant that has been decompressed at the main expansion mechanism 27 undergoes the gas-liquid separation. Specifically, the gas-liquid separator 51 is provided between the main expansion mechanism 27 and the subcooling heat exchanger 62 (one end of a first subcooling flow path 62*a*).

The degassing pipe 52 is a refrigerant pipe in which the main refrigerant flows, and, here, is a refrigerant pipe that extracts the main refrigerant in a gas state from the gas-liquid separator 51 and sends the main refrigerant in the gas state to a suction side of each of the main compressors 21 and 22. Specifically, the degassing pipe 52 is a refrigerant pipe that sends the main refrigerant in the gas state extracted from the gas-liquid separator 51 to the suction side of the first main compressor 21 via the suction injection pipe 61. One end of the degassing pipe 52 is connected so as to communicate with an upper space of the gas-liquid separator 51, and the other end of the degassing pipe 52 is connected to the suction injection pipe 61 (a first suction injection pipe 61*a*).

The degassing pipe 52 has a degassing expansion mechanism 53. The degassing expansion mechanism 53 is a device that decompresses the main refrigerant, and, here, is an expansion mechanism that decompresses a main refrigerant that flows in the degassing pipe 52. The degassing expansion mechanism 53 is, for example, an electrically powered expansion valve.

The suction injection pipe 61 is a refrigerant pipe in which the main refrigerant flows, and, here, is a refrigerant pipe that causes the main refrigerant that flows between the main heat-source-side heat exchanger 25 and the main use-side heat exchangers 72*a* and 72*b* to branch off and to be sent to the suction side of the main compressors 21 and 22. Specifically, the suction injection pipe 61 is a refrigerant pipe that causes the main refrigerant in a liquid state that flows between the gas-liquid separator 51 and the subcooling heat exchanger 62 (the one end of the first subcooling flow path 62*a*) to branch off and to be sent to the suction side of the first main compressor 21, and includes the first suction injection pipe 61*a* and a second suction injection pipe 61*b*. One end of the first suction injection pipe 61*a* is connected between the gas-liquid separator 51 and the subcooling heat exchanger 62 (the one end of the first subcooling flow path 62*a*), and the other end of the first suction injection pipe 61*a* is connected to the subcooling heat exchanger 62 (one end of a second subcooling flow path 62*b*). One end of the second suction injection pipe 61*b* is connected to the subcooling heat exchanger 62 (the other end of the second subcooling flow path 62*b*), and the other end of the second suction injection pipe 61*b* is connected to the suction side of the first compressor 21.

The suction injection pipe 61 has a suction injection expansion mechanism 63. The suction injection expansion mechanism 63 is provided at the first suction injection pipe 61*a*. The suction injection expansion mechanism 63 is a device that decompresses the main refrigerant, and, here, is an expansion mechanism that decompresses a main refrigerant that flows in the suction injection pipe 61. The suction injection expansion mechanism 63 is, for example, an electrically powered expansion valve. The other end of the degassing pipe 52 is connected to the first suction injection pipe 61*a* at a location between the suction injection expansion mechanism 63 and the subcooling heat exchanger 62 (the one end of the second subcooling flow path 62*b*).

The subcooling heat exchanger 62 is a device that causes main refrigerants to exchange heat with each other, and, here, is a heat exchanger that cools a main refrigerant that flows between the main expansion mechanism 27 and the main use-side heat exchangers 72*a* and 72*b* by heat exchange with the main refrigerant that flows in the suction injection pipe 61. Specifically, the subcooling heat exchanger 62 is a heat exchanger that cools a main refrigerant in a liquid state that flows between the gas-liquid separator 51 and the main use-side heat exchangers 72*a* and 72*b* (a second sub-flow path 85*b* of the sub-use-side heat exchanger 85) by heat exchange with the main refrigerant that flows in the suction injection pipe 61 and the main refrigerant that flows in the degassing pipe 52. The subcooling heat exchanger 62 has the first subcooling flow path 62*a* in which a main refrigerant that flows between the gas-liquid separator 51 and the main use-side heat exchangers 72*a* and 72*b* are caused to flow, and the second subcooling flow path 62*b* in which the main refrigerant that flows in the suction injection pipe 61 is caused to flow. One end (inlet) of the first subcooling flow path 62*a* is connected to the gas-liquid separator 51, and the other end (outlet) of the first subcooling flow path 62*a* is connected to the sub-use-side heat exchanger 85 (one end of the second sub-flow path 85*b*). One end (inlet) of the second subcooling flow path 62*b* is connected to the other end of the first suction injection pipe 61*a*, and the other end (outlet) of the second subcooling flow path 62*b* is connected to the one end of the second suction injection pipe 61*b*.

The sub-use-side heat exchanger 85 is a device that causes the main refrigerant and the sub-refrigerant to exchange heat with each other, and, here, is a heat exchanger that functions as a cooler of the main refrigerant that flows between the main expansion mechanism 27 and the main use-side heat exchangers 72*a* and 72*b*. Specifically, the sub-use-side heat exchanger 85 is a heat exchanger that cools a main refrigerant that flows between the subcooling heat exchanger 62 (the other end of the first subcooling flow path 62*a*) and the main use-side heat exchangers 72*a* and 72*b* (the main use-side expansion mechanisms 71*a* and 71*b*).

The main use-side expansion mechanisms 71*a* and 71*b* are each a device that decompresses the main refrigerant, and, here, are each an expansion mechanism that decompresses the main refrigerant that flows between the main expansion mechanism 27 and the main use-side heat exchangers 72*a* and 72*b*. Specifically, the main use-side expansion mechanisms 71*a* and 71*b* are each provided between the sub-use-side heat exchanger 85 (the other end of the second sub-flow path 85*b*) and one end (inlet) of each of the main use-side heat exchangers 72*a* and 72*b*. The main use-side expansion mechanisms 71*a* and 71*b* are each, for example, an electrically powered expansion valve.

The main use-side heat exchangers 72*a* and 72*b* are each a device that causes the main refrigerant and indoor air to exchange heat with each other, and, here, are each a heat exchanger that functions as an evaporator of the main refrigerant. The one end (inlet) of each of the main use-side heat exchangers 72*a* and 72*b* is connected to a corresponding one of the main use-side expansion mechanisms 71*a* and 71*b*, and the other end (outlet) of each of the main use-side heat exchangers 72*a* and 72*b* is connected to the suction side of the first compressor 21.

—Sub-Refrigerant Circuit—

The sub-refrigerant circuit 80 primarily has a sub-compressor 81, a sub-heat-source-side heat exchanger 83, and the sub-use-side heat exchanger 85. The sub-refrigerant circuit 80 has a sub-expansion mechanism 84. As the sub-refrigerant, a HFC refrigerant (such as R32), a HFO refrigerant (such as R1234yf or R1234ze), or a mixture refrigerant in which the HFC refrigerant and the HFO refrigerant are mixed (such as R452B) is sealed in the sub-refrigerant circuit 80, the HFC refrigerant, the HFO refrigerant, and the mixture refrigerant having a GWP (global warming potential) that is 750 or less. Note that the sub-refrigerant is not limited thereto, and may be a natural refrigerant having a coefficient of performance that is higher than that of carbon dioxide (such as propane or ammonia).

The sub-compressor 81 is a device that compresses the sub-refrigerant. The sub-compressor 81 is a compressor in which a compression element 81*a*, such as a rotary type or a scroll type, is driven by a driving mechanism, such as a motor or an engine.

The sub-heat-source-side heat exchanger 83 is a device that causes the sub-refrigerant and outdoor air to exchange heat with each other, and, here, is a heat exchanger that functions as a heat dissipater of the sub-refrigerant. One end (inlet) of the sub-heat-source-side heat exchanger 83 is connected to a discharge side of the sub-compressor 81, and the other end (outlet) of the sub-heat-source-side heat exchanger 83 is connected to the sub-expansion mechanism 84.

The sub-expansion mechanism 84 is a device that decompresses the sub-refrigerant, and, here, is an expansion mechanism that decompresses a sub-refrigerant that flows between the sub-heat-source-side heat exchanger 83 and the sub-use-side heat exchanger 85. Specifically, the sub-expansion mechanism 84 is provided between the other end (outlet) of the sub-heat-source-side heat exchanger 83 and the sub-use-side heat exchanger 85 (one end of a first sub-flow path 85*a*). The sub-expansion mechanism 84 is, for example, an electrically powered expansion valve.

As described above, the sub-use-side heat exchanger 85 is a device that causes the main refrigerant and the sub-refrigerant to exchange heat with each other, and, here, functions as an evaporator of the sub-refrigerant and is a heat exchanger that cools the main refrigerant that flows between the main expansion mechanism 27 and the main use-side heat exchangers 72*a* and 72*b*. Specifically, the sub-use-side heat exchanger 85 is a heat exchanger that cools a main refrigerant that flows between the subcooling heat exchanger 62 (the other end of the first subcooling flow path 62*a*) and the main use-side heat exchangers 72*a* and 72*b* (the main use-side expansion mechanisms 71*a* and 71*b*) by using a refrigerant that flows in the sub-refrigerant circuit 80. The sub-use-side heat exchanger 85 has the first sub-flow path 85*a* in which the sub-refrigerant is caused to flow between the sub-expansion mechanism 84 and a suction side of the sub-compressor 81, and the second sub-flow path 85*b* in which the main refrigerant is caused to flow between the subcooling heat exchanger 62 and the main use-side heat exchangers 72*a* and 72*b*. One end (inlet) of the first sub-flow path 85*a* is connected to the sub-expansion mechanism 84, and the other end (outlet) of the first sub-flow path 85*a* is connected to the suction side of the sub-compressor 81. The one end (inlet) of the second sub-flow path 85*b* is connected to the subcooling heat exchanger 62 (the other end of the first subcooling flow path 62*a*), and the other end (outlet) of the second sub-flow path 85*b* is connected to the main use-side expansion mechanisms 71*a* and 71*b*.

<Unit Configuration>

The constituent devices of the main refrigerant circuit 20 and the sub-refrigerant circuit 80 above are provided at a heat-source unit 2, a plurality of use units 7*a* and 7*b*, and a sub-unit 8. The use units 7*a* and 7*b* are each provided in correspondence with a corresponding one of the main use-side heat exchangers 72*a* and 72*b*.

—Heat-Source Unit—

The heat-source unit 2 is disposed outdoors. The main refrigerant circuit 20 excluding the sub-use-side heat exchanger 85, the main use-side expansion mechanisms 71*a* and 71*b*, and the main use-side heat exchangers 72*a* and 72*b* is provided at the heat-source unit 2.

A heat-source-side fan 28 for sending outdoor air to the main heat-source-side heat exchanger 25 and the intermediate heat exchanger 26 is provided at the heat-source unit 2. The heat-source-side fan 28 is a fan in which a blowing element, such as a propeller fan, is driven by a driving mechanism, such as a motor.

The heat-source unit 2 is provided with various sensors. Specifically, a pressure sensor 91 and a temperature sensor 92 that detect the pressure and the temperature of a main refrigerant on the suction side of the first main compressor 21 are provided. A pressure sensor 93 that detects the pressure of a main refrigerant on a discharge side of the first main compressor 21 is provided. A pressure sensor 94 and a temperature sensor 95 that detect the pressure and the temperature of a main refrigerant on a discharge side of the second main compressor 21 are provided. A temperature sensor 96 that detects the temperature of a main refrigerant on the other end (outlet) side of the main heat-source-side heat exchanger 25 is provided. A pressure sensor 97 and a temperature sensor 98 that detect the pressure and the temperature of a main refrigerant at the gas-liquid separator 51 are provided. A temperature sensor 64 that detects the temperature of a main refrigerant on the other end side of the subcooling heat exchanger 62 (the other end of the first subcooling flow path 62*a*) is provided. A temperature sensor 65 that detects the temperature of a main refrigerant at the second suction injection pipe 61*b* is provided. A temperature sensor 105 that detects the temperature of a main refrigerant on the other end side of the sub-use-side heat exchanger 85 (the other end of the second sub-flow path 85*b*) is provided. A temperature sensor 99 that detects the temperature of outdoor air (outside air temperature) is provided.

—Use Units—

The use units 7*a* and 7*b* are disposed indoors. The main use-side expansion mechanisms 71*a* and 71*b* and the main use-side heat exchangers 72*a* and 72*b* of the main refrigerant circuit 20 are provided at a corresponding one of the use units 7*a* and 7*b*.

Use-side fans 73*a* and 73*b* for sending indoor air to a corresponding one of the main use-side heat exchangers 72*a* and 72*b* are provided at a corresponding one of the use units 7*a* and 7*b*. Each of the indoor fans 73*a* and 73*b* is a fan in which a blowing element, such as a centrifugal fan or a multiblade fan, is driven by a driving mechanism, such as a motor.

The use units 7*a* and 7*b* are provided with various sensors. Specifically, temperature sensors 74*a* and 74*b* that detect the temperature of a main refrigerant on one end (inlet) side of a corresponding one of the main use-side heat exchangers 72*a* and 72*b*, and temperature sensors 75*a* and 75*b* that detect the temperature of a main refrigerant on the other end (outlet) side of a corresponding one of the main use-side heat exchangers 72*a* and 72*b* are provided.

—Sub-Unit—

The sub-unit 8 is disposed outdoors. The sub-refrigerant circuit 80 and a part of a refrigerant pipe that constitutes the main refrigerant circuit 20 (a part of the refrigerant pipe that is connected to the sub-use-side heat exchanger 85 and in which the main refrigerant flows) are provided at the sub-unit 8.

A sub-side fan 86 for sending outdoor air to the sub-heat-source-side heat exchanger 83 is provided at the sub-unit 8. The sub-side fan 86 is a fan in which a blowing element, such as a propeller fan, is driven by a driving mechanism, such as a motor.

Here, although the sub-unit 8 is provided adjacent to the heat-source unit 2 and the sub-unit 8 and the heat-source unit 2 are substantially integrated with each other, it is not limited thereto. The sub-unit 8 may be provided apart from the heat-source unit 2, or all constituent devices of the sub-unit 8 may be provided at the heat-source unit 2 and the sub-unit 8 may be omitted.

The sub-unit 8 is provided with various sensors. Specifically, a pressure sensor 101 and a temperature sensor 102 that detect the pressure and the temperature of a sub-refrigerant on the suction side of the sub-compressor 81 are provided. A pressure sensor 103 and a temperature sensor 104 that detect the pressure and the temperature of a sub-refrigerant on the discharge side of the sub-compressor 81 are provided. A temperature sensor 106 that detects the temperature of outdoor air (outside air temperature) is provided.

—Main Refrigerant Connection Pipes—

The heat-source unit 2 and the use units 7*a* and 7*b* are connected to each other by main refrigerant connection pipes 11 and 12 that constitute a part of the main refrigerant circuit 20.

The first main refrigerant connection pipe 11 is a part of a pipe that connects the sub-use-side heat exchanger 85 (the other end of the second sub-flow path 85*b*) and the main use-side expansion mechanisms 71*a* and 71*b*.

The second main refrigerant connection pipe 12 is a part of a pipe that connects the other ends of the corresponding main use-side heat exchangers 72*a* and 72*b* and the suction side of the first main compressor 21.

—Control Unit—

The constituent devices of the heat-source unit 2, the use units 7*a* and 7*b*, and the sub-unit 8, including the constituent devices of the main refrigerant circuit 20 and the sub-refrigerant circuit 80 above, are controlled by a control unit 9. The control unit 9 is formed by communication-connection of, for example, a control board provided at the heat-source unit 2, the use units 7*a* and 7*b*, and the sub-unit 8, and is formed so as to be capable of receiving, for example, detection signals of the various sensors 64, 65, 74*a*, 74*b*, 75*a*, 75*b*, 91 to 99, and 101 to 106. Note that, for convenience sake, FIG. 1 illustrates the control unit 9 at a position situated away from, for example, the heat-source unit 2, the use units 7*a* and 7*b*, and the sub-unit 8. In this way, the control unit 9, based on, for example, the detection signals of, for example, the various sensors 64, 65, 74*a*, 74*b*, 75*a*, 75*b*, 91 to 99, and 101 to 106, controls the constituent devices 21, 22, 27, 28, 53, 63, 71*a*, 71*b*, 73*a*, 73*b*, 81, 84, and 86 of the refrigeration cycle device 1, that is, controls the operation of the entire refrigeration cycle device 1.

(2) Operation

Figure 2:
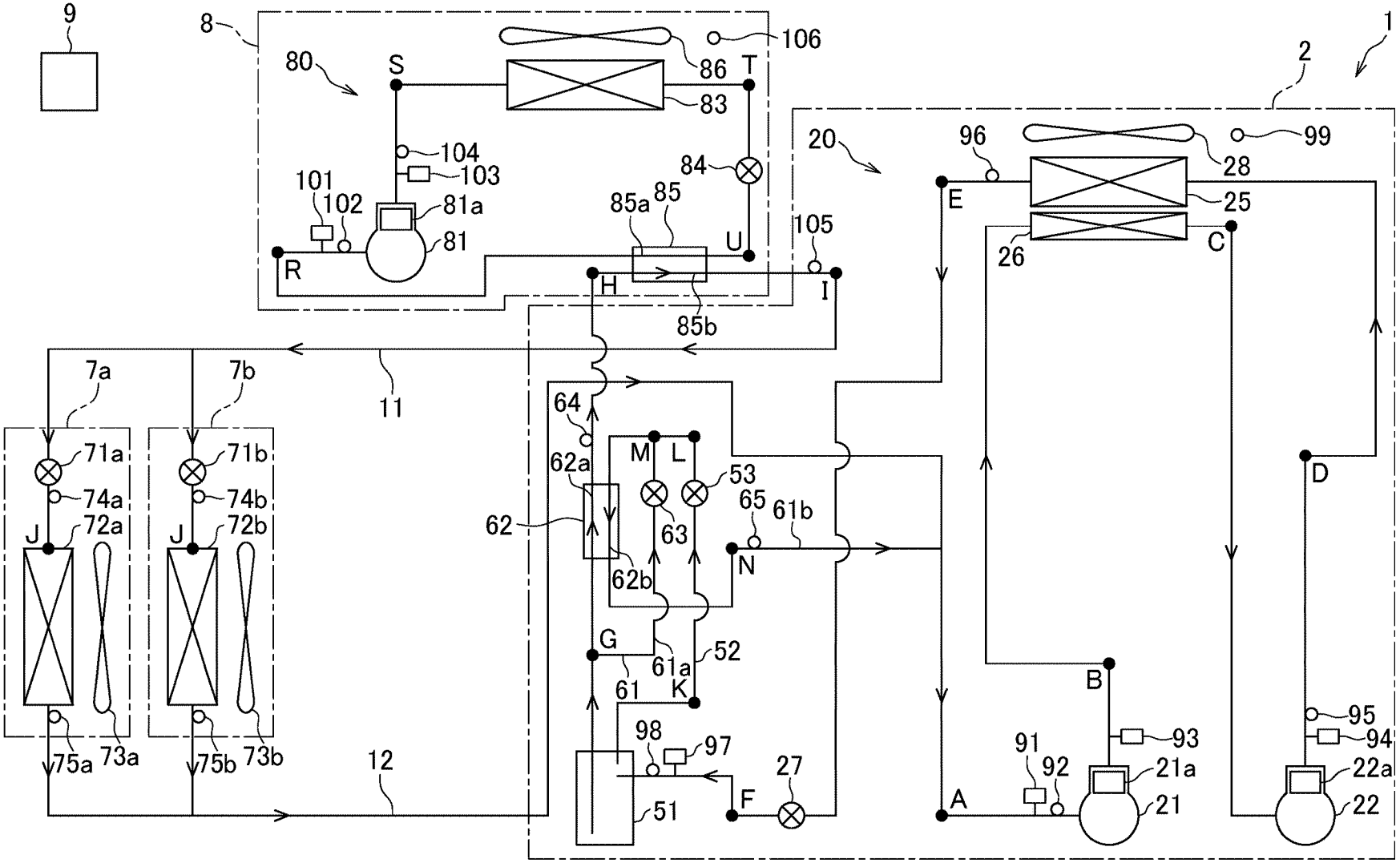
FIG. 2 illustrates flow of a refrigerant in the refrigeration cycle device at the time of a cooling operation accompanying a cooling action of the subcooling heat-exchanger.
Figure 3:
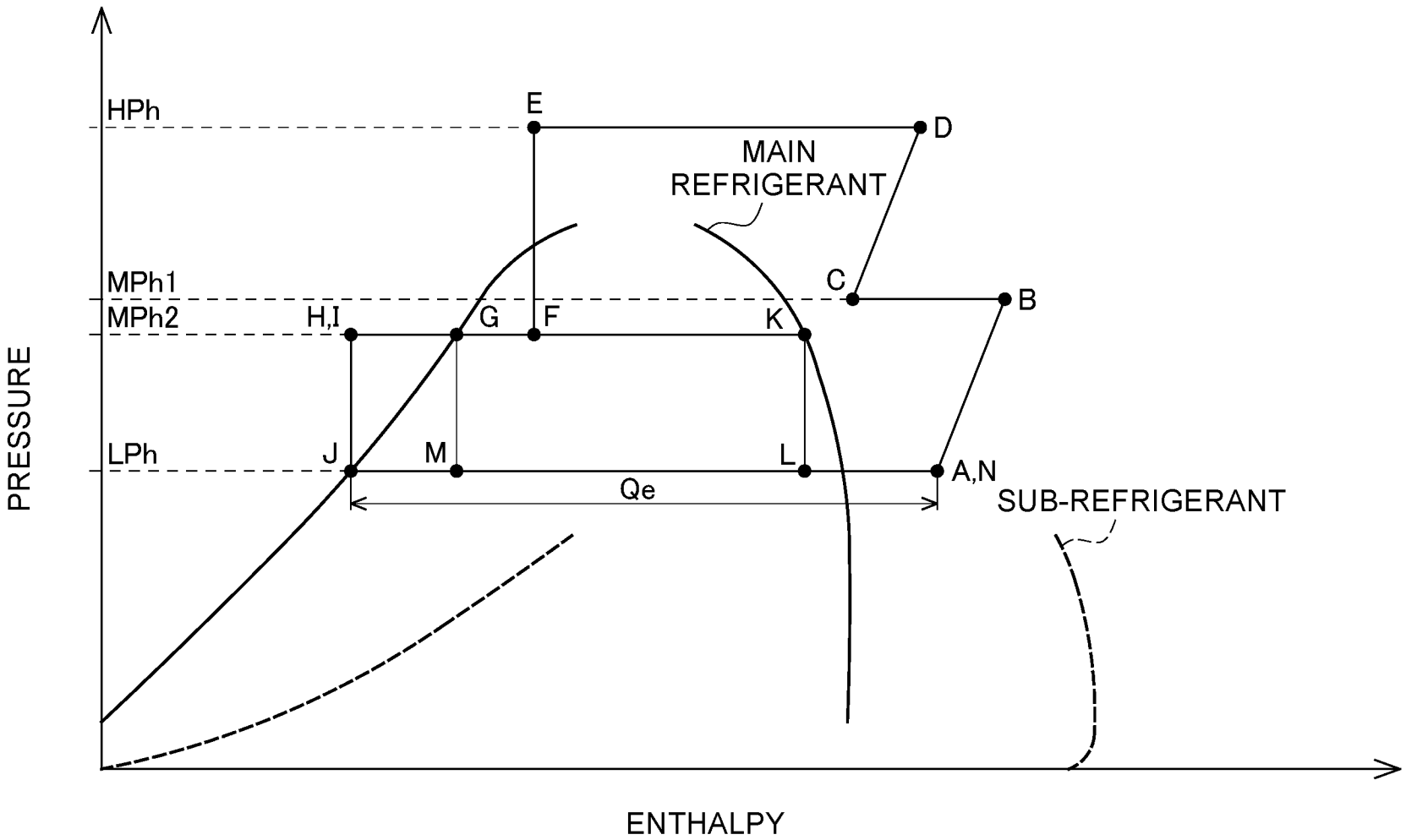
FIG. 3 is a pressure-enthalpy diagram illustrating the refrigeration cycle at the time of the cooling operation accompanying the cooling action of the subcooling heat-exchanger.
Figure 4:
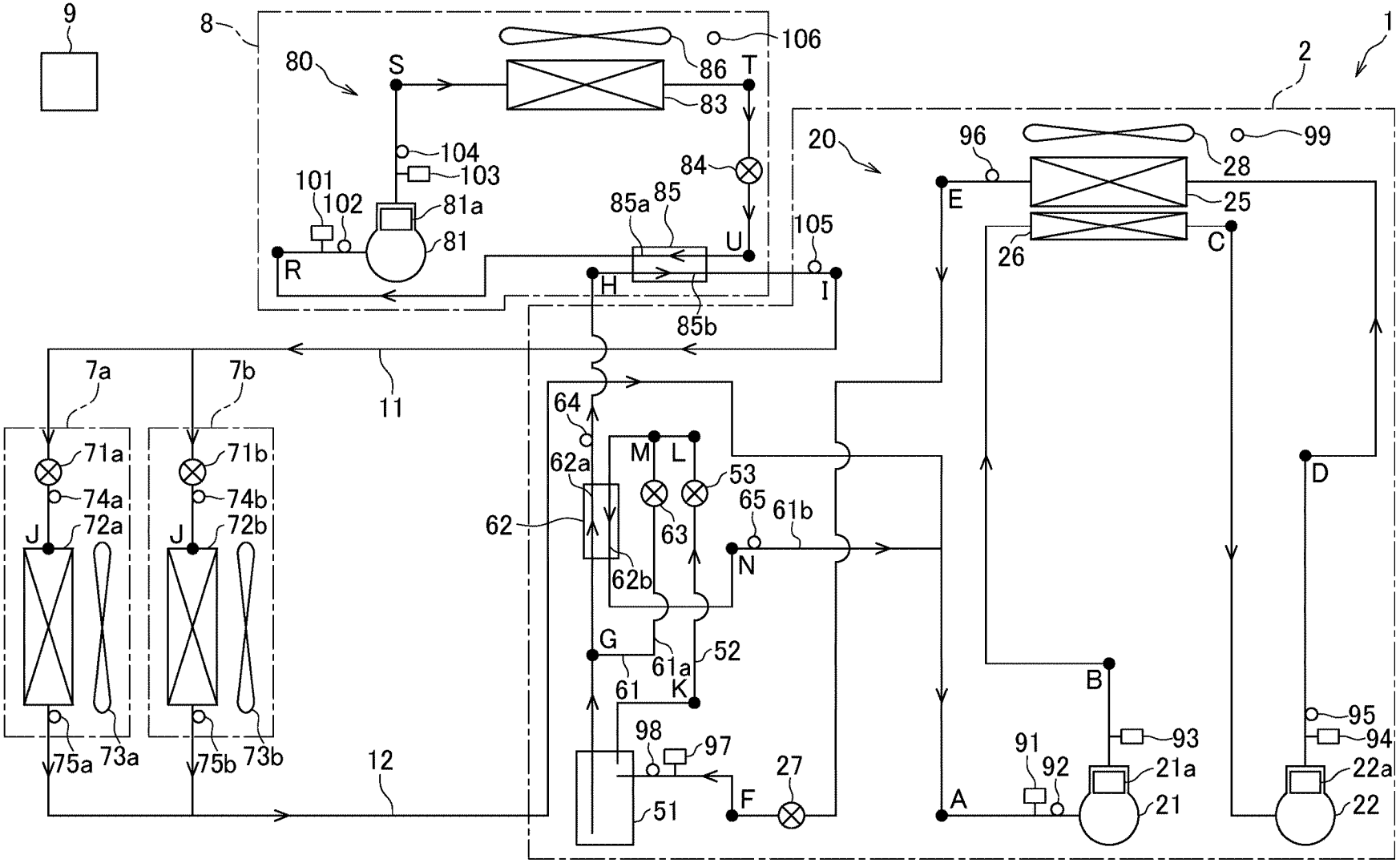
FIG. 4 illustrates flow of a refrigerant in the refrigeration cycle device at the time of a cooling operation accompanying a cooling action of the sub-refrigerant-circuit.
Figure 5:
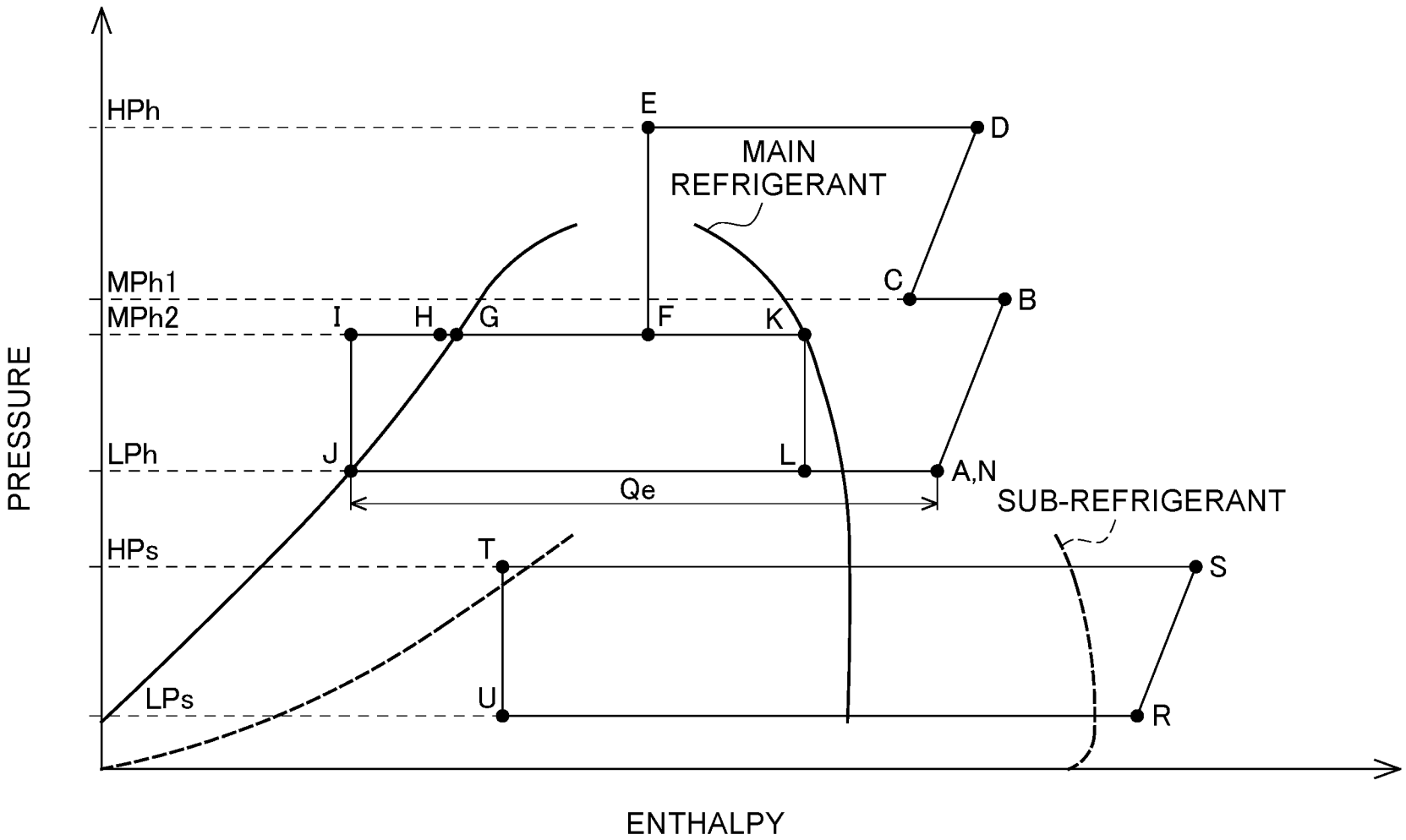
FIG. 5 is a pressure-enthalpy diagram illustrating the refrigeration cycle at the time of the cooling operation accompanying the cooling action of the sub-refrigerant-circuit.
Figure 6:
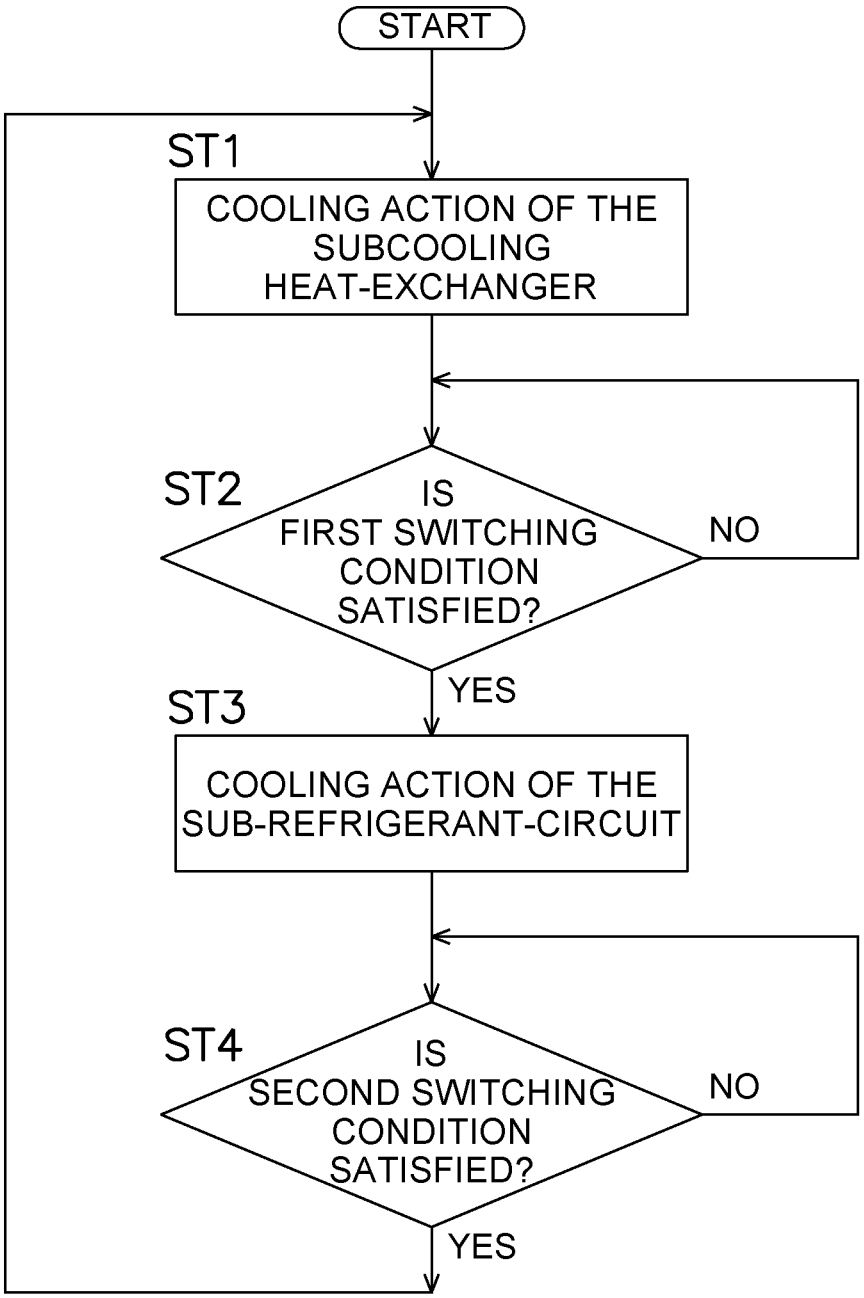
FIG. 6 is a flow chart of control for switching between the cooling action of the subcooling heat-exchanger and the cooling action of the sub-refrigerant-circuit.

Next, the operation of the refrigeration cycle device 1 is described by using FIGS. 2 to 6. Here, FIG. 2 illustrates flow of a refrigerant in the refrigeration cycle device 1 at the time of a cooling operation accompanying a cooling action of the subcooling heat-exchanger. FIG. 3 is a pressure-enthalpy diagram illustrating the refrigeration cycle at the time of the cooling operation accompanying the cooling action of the subcooling heat-exchanger. FIG. 4 illustrates flow of a refrigerant in the refrigeration cycle device 1 at the time of a cooling operation accompanying a cooling action of the sub-refrigerant-circuit. FIG. 5 is a pressure-enthalpy diagram illustrating the refrigeration cycle at the time of the cooling operation accompanying the cooling action of the sub-refrigerant-circuit. FIG. 6 is a flow chart of control for switching between the cooling action of the subcooling heat-exchanger and the cooling action of the sub-refrigerant-circuit.

The refrigeration cycle device 1 is capable of performing, as an air-conditioning operation of the interior of a room, a cooling operation that cools indoor air with the main use-side heat exchangers 72*a* and 72*b* functioning as evaporators of the main refrigerant. In addition, here, at the time of the cooling operation, cooling action of the subcooling heat-exchanger that cools the main refrigerant by using the suction injection pipe 61 and the subcooling heat exchanger 62 and the cooling action of the sub-refrigerant-circuit that cools the main refrigerant by using the sub-refrigerant circuit 80 can be performed by switching between the actions. Note that the actions for the cooling operation including the cooling action of the subcooling heat-exchanger, the cooling action of the sub-refrigerant-circuit, and the switching between the cooling action of the subcooling heat-exchanger and the cooling action of the sub-refrigerant-circuit are performed by the control unit 9.

<Cooling Operation Accompanying Cooling Action of Subcooling Heat-Exchanger>

At the time of the cooling operation accompanying the cooling action of the subcooling heat-exchanger, since the suction injection pipe 61 and the subcooling heat exchanger 62 are used, the suction injection expansion mechanism 63 is opened and since the sub-refrigerant circuit 80 is not used, the operation of the sub-compressor 81 is stopped.

In the state of the main refrigerant circuit 20, the main refrigerant at a low pressure (LPh) (refer to point A in FIGS. 2 and 3) in the refrigeration cycle is sucked by the first main compressor 21, and, at the first main compressor 21, the main refrigerant is compressed up to an intermediate pressure (MPh1) in the refrigeration cycle and is discharged (refer to point B in FIGS. 2 and 3).

The main refrigerant at the intermediate pressure discharged from the first main compressor 21 is sent to the intermediate heat exchanger 26, and, at the intermediate heat exchanger 26, exchanges heat with outdoor air that is sent by the heat-source-side fan 28 and is cooled (refer to point C in FIGS. 2 and 3).

The main refrigerant at the intermediate pressure that has been cooled at the intermediate heat exchanger 26 is sucked by the second main compressor 22, and, at the second main compressor 22, is compressed up to a high pressure (HPh) in the refrigeration cycle and is discharged (refer to point D in FIGS. 2 and 3). Here, the main refrigerant at the high pressure discharged from the second main compressor 22 has a pressure that exceeds the critical pressure of the main refrigerant.

The main refrigerant at the high pressure discharged from the second main compressor 22 is sent to the main heat-source-side heat exchanger 25, and, at the main heat-source-side heat exchanger 25, exchanges heat with outdoor air that is sent by the heat-source-side fan 28 and is cooled (refer to point E in FIGS. 2 and 3).

The main refrigerant at the high pressure that has been cooled at the main heat-source-side heat exchanger 25 is sent to the main expansion mechanism 27, and, at the main expansion mechanism 27, is decompressed up to an intermediate pressure (MPh2) in the refrigeration cycle, and is brought into a gas-liquid two-phase state (refer to point F in FIGS. 2 and 3). Here, the intermediate pressure (MPh2) is a pressure that is lower than the intermediate pressure (MPh1).

The main refrigerant at the intermediate pressure that has been decompressed at the main expansion mechanism 27 is sent to the gas-liquid separator 51, and, at the gas-liquid separator 51, is separated into a main refrigerant in a gas state (refer to point K in FIGS. 2 and 3) and a main refrigerant in a liquid state (refer to point G in FIGS. 2 and 3).

The main refrigerant at the intermediate pressure and in the gas state that has been separated at the gas-liquid separator 51 is extracted from the gas-liquid separator 51 to the degassing pipe 52 in accordance with the opening degree of the degassing expansion mechanism 53. The main refrigerant at the intermediate pressure and in the gas state that has been extracted to the degassing pipe 52 is decompressed up to the low pressure (LPh) (refer to point L in FIGS. 2 and 3) in the degassing expansion mechanism 53 and is sent to the suction injection pipe 61 (downstream side of the suction injection expansion mechanism 63 at the first suction injection pipe 61*a*).

Here, the opening degree of the degassing expansion mechanism 53 is adjusted based on the pressure (MPh2) of the main refrigerant at the gas-liquid separator 51. For example, the control unit 9 controls the opening degree of the degassing expansion mechanism 53 so that the pressure (MPh2) of the main refrigerant at the gas-liquid separator 51 becomes a target value MPh2*t*. Note that the intermediate pressure MPh2 is detected by the pressure sensor 97.

A part of the main refrigerant at the intermediate pressure and in the liquid state that has been separated at the gas-liquid separator 51 branches off into the suction injection pipe 61 in accordance with the opening degree of the suction injection expansion mechanism 63, and the remaining main refrigerant is sent to the subcooling heat exchanger 62 (the first subcooling flow path 62*a*). The main refrigerant at the intermediate pressure and in the liquid state that has branched off into the suction injection pipe 61 is decompressed up to the low pressure (LPh) and is brought into a gas-liquid two-phase state (refer to point M in FIGS. 2 and 3) in the suction injection expansion mechanism 63, merges with a main refrigerant at a low pressure that is sent from the degassing pipe 52, and is sent to the subcooling heat exchanger 62 (the second subcooling flow path 62*b*). At the sub-cooling heat exchanger 62, the main refrigerant at the intermediate pressure and in the liquid state that flows in the first subcooling flow path 62*a* exchanges heat with the main refrigerant at the low pressure and in the gas-liquid two-phase state that flows in the second subcooling flow path 62*b*, and is cooled (refer to point H in FIGS. 2 and 3). In contrast, the main refrigerant at the low pressure and in the gas-liquid two-phase state that flows in the second subcooling flow path 62*b* exchanges heat with the main refrigerant at the intermediate pressure and in the liquid state that flows in the first subcooling flow path 62*a* and is heated (refer to point N in FIGS. 2 and 3), and is sent to the suction side of the first main compressor 21.

Here, the opening degree of the suction injection expansion mechanism 63 is adjusted based on a superheating degree SHh1 of a main refrigerant at an outlet of the subcooling heat exchanger 62 on a side of the suction injection pipe 61. For example, the control unit 9 controls the opening degree of the suction injection expansion mechanism 63 so that the superheating degree SHh1 becomes a target value SHh1*t*. Note that the superheating degree SHh1 is obtained by converting the pressure (LPh) of the main refrigerant that is detected by the pressure sensor 91 into saturation temperature, and subtracting the saturation temperature from the temperature of the main refrigerant that is detected by the temperature sensor 65.

The main refrigerant at the intermediate pressure that has been cooled at the subcooling heat exchanger 62, after passing through the sub-use-side heat exchanger 85 (the second sub-flow path 85*b*) (refer to point I in FIGS. 2 and 3), is sent to the main use-side expansion mechanisms 71*a* and 71*b* via the first main refrigerant connection pipe 11, and, at the main use-side expansion mechanisms 71*a* and 71*b*, is decompressed up to the low pressure (LPh), and is brought into a gas-liquid two-phase state (refer to points J in FIGS. 2 and 3). Note that, here, since the operation of the sub-compressor 81 is stopped and the sub-refrigerant does not circulate in the sub-refrigerant circuit 80, the main refrigerant and the sub-refrigerant do not exchange heat with each other at the sub-use-side heat exchanger 85 (refer to the points H and I in FIGS. 2 and 3).

The main refrigerant at the low pressure that has been decompressed at the main use-side expansion mechanisms 71*a* and 71*b* is sent to the corresponding main use-side heat exchangers 72*a* and 72*b*, and, at the corresponding main use-side heat exchangers 72*a* and 72*b*, exchanges heat with indoor air that is sent by the corresponding use-side fans 73*a* and 73*b*, is heated, and evaporates (refer to the point A in FIGS. 2 and 3). In contrast, the indoor air exchanges heat with the main refrigerant at the low pressure and in the gas-liquid two-phase state that flows in the main use-side heat exchangers 72*a* and 72*b* and is cooled, as a result of which the interior of a room is cooled.

The main refrigerant at the low pressure that has evaporated at the main use-side heat exchangers 72*a* and 72*b* is sent to the suction side of the first main compressor 21 via the second main refrigerant connection pipe 12 and is, together with the main refrigerant that merges therewith from the suction injection pipe 61, sucked by the first main compressor 21 again. In this way, the cooling operation accompanying the cooling action of the subcooling heat-exchanger is performed.

<Cooling Operation Accompanying Cooling Action of Sub-Refrigerant-Circuit>

At the time of the cooling operation accompanying the cooling action of the sub-refrigerant-circuit, since the sub-refrigerant circuit 80 is used, the sub-compressor 81 is operated and since the suction injection pipe 61 and the subcooling heat exchanger 62 are hardly used, the suction injection expansion mechanism 63 is closed.

In the state of the main refrigerant circuit 20, the main refrigerant at the low pressure (LPh) (refer to point A in FIGS. 4 and 5) in the refrigeration cycle is sucked by the first main compressor 21, and, at the first main compressor 21, the main refrigerant is compressed up to the intermediate pressure (MPh1) in the refrigeration cycle and is discharged (refer to point B in FIGS. 4 and 5).

The main refrigerant at the intermediate pressure discharged from the first main compressor 21 is sent to the intermediate heat exchanger 26, and, at the intermediate heat exchanger 26, exchanges heat with outdoor air that is sent by the heat-source-side fan 28 and is cooled (refer to point C in FIGS. 4 and 5).

The main refrigerant at the intermediate pressure that has been cooled at the intermediate heat exchanger 26 is sucked by the second main compressor 22, and, at the second main compressor 22, is compressed up to a high pressure (HPh) in the refrigeration cycle and is discharged (refer to point D in FIGS. 4 and 5). Here, the main refrigerant at the high pressure discharged from the second main compressor 22 has a pressure that exceeds the critical pressure of the main refrigerant.

The main refrigerant at the high pressure discharged from the second main compressor 22 is sent to the main heat-source-side heat exchanger 25, and, at the main heat-source-side heat exchanger 25, exchanges heat with outdoor air that is sent by the heat-source-side fan 28 and is cooled (refer to point E in FIGS. 4 and 5).

The main refrigerant at the high pressure that has been cooled at the main heat-source-side heat exchanger 25 is sent to the main expansion mechanism 27, and, at the main expansion mechanism 27, is decompressed up to the intermediate pressure (MPh2) in the refrigeration cycle, and is brought into a gas-liquid two-phase state (refer to point F in FIGS. 4 and 5). Here, the intermediate pressure (MPh2) is a pressure that is lower than the intermediate pressure (MPh1).

The main refrigerant at the intermediate pressure that has been decompressed at the main expansion mechanism 27 is sent to the gas-liquid separator 51, and, at the gas-liquid separator 51, is separated into a main refrigerant in a gas state (refer to point K in FIGS. 4 and 5) and a main refrigerant in a liquid state (refer to point G in FIGS. 4 and 5).

The main refrigerant at the intermediate pressure and in the gas state that has been separated at the gas-liquid separator 51 is extracted from the gas-liquid separator 51 to the degassing pipe 52 in accordance with the opening degree of the degassing expansion mechanism 53. The main refrigerant at the intermediate pressure and in the gas state that has been extracted to the degassing pipe 52 is decompressed up to the low pressure (LPh) (refer to point L in FIGS. 4 and 5) in the degassing expansion mechanism 53 and is sent to the suction injection pipe 61 (downstream side of the suction injection expansion mechanism 63 at the first suction injection pipe 61*a*). Here, the opening degree of the degassing expansion mechanism 53 is adjusted based on the pressure (MPh2) of the main refrigerant at the gas-liquid separator 51. For example, the control unit 9 controls the opening degree of the degassing expansion mechanism 53 so that the pressure (MPh2) of the main refrigerant at the gas-liquid separator 51 becomes a target value MPh2*s*. Note that the intermediate pressure MPh2 is detected by the pressure sensor 97.

Since the suction injection expansion mechanism 63 is closed, the main refrigerant at the intermediate pressure and in the liquid state that has been separated at the gas-liquid separator 51 is sent to the subcooling heat exchanger 62 (the first subcooling flow path 62*a*) without branching off into the suction injection pipe 61. Therefore, only a main refrigerant at a low pressure that is sent from the degassing pipe 53 flows in the suction injection pipe 61, and the main refrigerant at the low pressure is sent to the subcooling heat exchanger 62 (the second subcooling flow path 62*b*). At the sub-cooling heat exchanger 62, the main refrigerant at the intermediate pressure and in the liquid state that flows in the first subcooling flow path 62*a* exchanges heat with the main refrigerant at the low pressure and in the gas-liquid two-phase state that flows in the second subcooling flow path 62*b*, and is cooled (refer to point H in FIGS. 4 and 5). In contrast, the main refrigerant at the low pressure and in the gas-liquid two-phase state that flows in the second subcooling flow path 62*b* exchanges heat with the main refrigerant at the intermediate pressure and in the liquid state that flows in the first subcooling flow path 62*a* and is heated (refer to point N in FIGS. 4 and 5), and is sent to the suction side of the first main compressor 21. Note that, here, since the suction injection expansion mechanism 63 is closed and the flow rate of the main refrigerant that flows in the suction injection pipe 61 is small, heat exchange is hardly performed at the subcooling heat exchanger 62 (refer to the points G and H in FIGS. 4 and 5).

The main refrigerant at the intermediate pressure that is slightly cooled at the subcooling heat exchanger 62 is sent to the sub-use-side heat exchanger 85 (second sub-flow path 85*b*).

On the other hand, at the sub-refrigerant circuit 80, the sub-refrigerant (refer to point R in FIGS. 4 and 5) at the low pressure (LPs) in the refrigeration cycle is sucked by the sub-compressor 81, and, at the sub-compressor 81, the sub-refrigerant is compressed up to a high pressure (HPs) in the refrigeration cycle and is discharged (refer to point S in FIGS. 4 and 5).

The sub-refrigerant at the high pressure discharged from the sub-compressor 81 is sent to the sub-heat-source-side heat exchanger 83, and, at the sub-heat-source-side heat exchanger 83, exchanges heat with outdoor air that is sent by the sub-side fan 86 and is cooled (refer to point T in FIGS. 4 and 5).

The sub-refrigerant at the high pressure that has been cooled at the sub-heat-source-side heat exchanger 83 is sent to the sub-expansion mechanism 84, and, at the sub-expansion mechanism 84, is decompressed up to a low pressure and is brought into a gas-liquid two-phase state (refer to point U in FIGS. 4 and 5).

Then, at the sub-use-side heat exchanger 85, a main refrigerant at the intermediate pressure that flows in the second sub-flow path 85*b* exchanges heat with the sub-refrigerant at the low pressure and in the gas-liquid two-phase state that flows in the first sub-flow path 85*a*, and is cooled (refer to point I in FIGS. 4 and 5). In contrast, the sub-refrigerant at the low pressure and in the gas-liquid two-phase state that flows in the first sub-flow path 85*a* exchanges heat with the main refrigerant at the intermediate pressure that flows in the second sub-flow path 85*b* and is heated (refer to point R in FIGS. 4 and 5), and is sucked in on the suction side of the sub-compressor 81 again.

Here, the operating capacity of the sub-compressor 81 is adjusted based on the low pressure LPs of the sub-refrigerant circuit 80. For example, the control unit 9 controls the operating capacity (operating frequency and number of rotations) of the sub-compressor 81 so that the low pressure LPs becomes a target value LPst. Note that the low pressure LPs is detected by the pressure sensor 101. The opening degree of the sub-expansion mechanism 84 is adjusted based on a superheating degree SHs1 of a sub-refrigerant at an outlet of the sub-use-side heat exchanger 85 on a side of the sub-refrigerant circuit 80. For example, the control unit 9 controls the opening degree of the sub-expansion mechanism 84 so that the superheating degree SHs1 becomes a target value SHs1*t*. Note that the superheating degree SHs1 is obtained by converting the pressure (LPs) of the sub-refrigerant that is detected by the pressure sensor 101 into saturation temperature, and subtracting the saturation temperature from the temperature of the sub-refrigerant that is detected by the temperature sensor 102.

The main refrigerant at the intermediate pressure that has been cooled at the sub-use-side heat exchanger 85 is sent to the main use-side expansion mechanisms 71*a* and 71*b* via the first main refrigerant connection pipe 11, and, at the main use-side expansion mechanisms 71*a* and 71*b*, is decompressed up to the low pressure (LPh) and is brought into a gas-liquid two-phase state (refer to points J in FIGS. 4 and 5).

The main refrigerant at the low pressure that has been decompressed at the main use-side expansion mechanisms 71*a* and 71*b* is sent to the corresponding main use-side heat exchangers 72*a* and 72*b*, and, at the corresponding main use-side heat exchangers 72*a* and 72*b*, exchanges heat with indoor air that is sent by the corresponding use-side fans 73*a* and 73*b*, is heated, and evaporates (refer to the point A in FIGS. 4 and 5). In contrast, the indoor air exchanges heat with the main refrigerant at the low pressure and in the gas-liquid two-phase state that flows in the main use-side heat exchangers 72*a* and 72*b* and is cooled, as a result of which the interior of a room is cooled.

The main refrigerant at the low pressure that has evaporated at the main use-side heat exchangers 72*a* and 72*b* is sent to the suction side of the first main compressor 21 via the second main refrigerant connection pipe 12 and is, together with the main refrigerant that merges therewith from the suction injection pipe 61, sucked by the first main compressor 21 again. In this way, the cooling operation accompanying the cooling action of the sub-refrigerant-circuit is performed.

<Switching Between Cooling Action of Subcooling Heat-Exchanger and Cooling Action of Sub-Refrigerant-Circuit>

Next, switching between the cooling action of the subcooling heat-exchanger and the cooling action of the sub-refrigerant-circuit at the time of the cooling operation is described.

By performing the cooling action of the subcooling heat-exchanger at the time of the cooling operation, the enthalpy of the refrigerant that is sent to the main use-side heat exchangers 72*a* and 72*b* is reduced, and a heat exchange capacity Qe that is obtained by evaporation of the refrigerant at the main use-side heat exchangers 72*a* and 72*b* (evaporation capacity of the main use-side heat exchangers) can be increased. However, for example, under an operating condition in which an outside air temperature Ta is high, since the heat-dissipating capacity of the main refrigerant at the main heat-source-side heat exchanger 25 is reduced, even if the cooling action of the subcooling heat-exchanger is performed, the enthalpy of the refrigerant that is sent to the main use-side heat exchangers 72*a* and 72*b* is not sufficiently reduced, as a result of which it tends to be difficult to increase the evaporation capacity of the main use-side heat exchangers 72*a* and 72*b*. In particular, when carbon dioxide having a coefficient of performance that is lower than the coefficient of performance of, for example, a HFC refrigerant is used as the main refrigerant, this tendency becomes noticeable. In contrast, under an operating condition in which the outside air temperature Ta is low, since the heat-dissipating capacity of the main refrigerant at the main heat-source-side heat exchanger 25 is increased, the enthalpy of the refrigerant that is sent to the main use-side heat exchangers 72*a* and 72*b* is sufficiently reduced (refer to the points H, I, and J in FIG. 3) by performing only the cooling action of the subcooling heat-exchanger, as a result of which the evaporation capacity Qe of the main use-side heat exchangers 72*a* and 72*b* has a tendency to increase easily.

Therefore, here, as shown in FIG. 6, the control unit 9 switches between the cooling action of the subcooling heat-exchanger and the cooling action of the sub-refrigerant-circuit in accordance with state quantities, such as the outside air temperature Ta.

When a command to perform the cooling operation is issued to the control unit 9, first, in Step ST1, the control unit 9 performs the cooling operation accompanying the cooling action of the subcooling heat-exchanger. That is, when the sub-compressor 81 is in a stopped state (that is, when the cooling action of the sub-refrigerant-circuit is in a stopped state), the control unit 9 opens the suction injection expansion mechanism 63 to start the cooling action of the subcooling heat-exchanger.

Next, in Step ST2, the control unit 9 determines whether the condition of state quantities, such as the outside air temperature Ta, (first switching condition) for performing only the cooling action of the sub-refrigerant-circuit is satisfied.

Here, the first switching condition is a condition of state quantities, such as the outside air temperature Ta, for determining whether, of the cooling action of the sub-refrigerant-circuit and the cooling action of the subcooling heat-exchanger, only the cooling action of the sub-refrigerant-circuit is to be performed.

When, due to, for example, an increase in the outside air temperature Ta, the enthalpy of the main refrigerant that is sent to the main use-side heat exchangers 72*a* and 72*b* becomes difficult to reduce even if the cooling action of the subcooling heat-exchanger is performed, the coefficient of performance of the refrigeration cycle device 1 tends to be reduced. In addition, when this tendency is increased, reducing the enthalpy of the main refrigerant that is sent to the main use-side heat exchangers 72*a* and 72*b* by the cooling action of the sub-refrigerant-circuit rather realizes the condition of increasing the coefficient of performance of the refrigeration cycle device 1 even when consumption energy of the sub-compressor 81 is considered.

Therefore, here, the condition in which the cooling action of the sub-refrigerant-circuit increases the coefficient of performance of the refrigeration cycle device 1 greater than the cooling action of the subcooling heat-exchanger is prescribed as the first switching condition. As state quantities for determining whether the first switching condition is satisfied, the outside air temperature Ta, a temperature Th1 of the main refrigerant at the main heat-source-side heat exchanger 25, a subcooling degree SCh1 of the main refrigerant at the outlet of the subcooling heat exchanger 62, or a subcooling degree SCh2 of the main refrigerant at the outlet of the sub-use-side heat exchanger 85 is used. Note that the outside air temperature Ta is detected by the temperature sensor 99 or the temperature sensor 106. The temperature Th1 is detected by the temperature sensor 96. The subcooling degree SCh1 is obtained by subtracting the temperature of the main refrigerant that is detected by the temperature sensor 64 from the temperature of the main refrigerant that is detected by the temperature sensor 98. The subcooling degree SCh2 is obtained by subtracting the temperature of the main refrigerant that is detected by the temperature sensor 105 from the temperature of the main refrigerant that is detected by the temperature sensor 98.

In Step ST2, when the outside air temperature Ta is greater than or equal to a first temperature Tat1, when the temperature Th1 is greater than or equal to a second temperature Th1*t*1, when the subcooling degree SCh1 is less than or equal to a first subcooling degree SCh1*t*1, or when the subcooling degree SCh2 is less than or equal to a second subcooling degree SCh2*t*1, the control unit 9 determines that the first switching condition is satisfied. That is, it is determined that, in the cooling action of the subcooling heat-exchanger, the enthalpy of the main refrigerant that is sent to the main use-side heat exchangers 72*a* and 72*b* is not sufficiently reduced. Here, the first temperature Tat1 and the second temperature Th1*t*1 are set at about 30--45° C., and the first subcooling degree SCh1*t*1 and the second subcooling degree SCh2*t*1 are set at about 0--5° C.

In Step ST2, when the state quantities, such as the outside air temperature Ta, do not satisfy the first switching condition, the control unit 9 continues the cooling action of the subcooling heat-exchanger of Step ST1, and when the state quantities, such as the outside air temperature Ta, satisfy the first switching condition, the control unit 9 proceeds to Step ST3 and switches from the cooling action of the subcooling heat-exchanger to the cooling action of the sub-refrigerant-circuit. That is, the control unit 9 stops the cooling action of the subcooling heat-exchanger by closing the suction injection expansion mechanism 63, and performs the cooling action of the sub-refrigerant-circuit by operating the sub-compressor 81. Therefore, by performing the cooling action of the sub-refrigerant-circuit, it is possible to sufficiently reduce the enthalpy of the main refrigerant that is sent to the main use-side heat exchangers 72*a* and 72*b*.

Next, in Step ST4, the control unit 9 determines whether a condition of the state quantities, such as the outside air temperature Ta, (a second switching condition) for performing only the cooling action of the subcooling heat-exchanger is satisfied.

Here, the second switching condition is a condition of the state quantities, such as the outside air temperature Ta, for determining whether, of the cooling action of the sub-refrigerant-circuit and the cooling action of the subcooling heat-exchanger, only the cooling action of the subcooling heat-exchanger is to be performed.

When, due to, for example, a reduction in the outside air temperature Ta, the enthalpy of the main refrigerant that is sent to the main use-side heat exchangers is sufficiently reduced by performing the cooling action of the subcooling heat-exchanger, the coefficient of performance of the refrigeration cycle device 1 has a tendency to increase. In addition, when this tendency is increased, reducing the enthalpy of the main refrigerant that is sent to the main use-side heat exchangers 72*a* and 72*b* by performing the cooling action of the sub-refrigerant-circuit rather realizes the condition of reducing the coefficient of performance of the refrigeration cycle device 1 when consumption energy of the sub-compressor 81 is considered.

Therefore, here, the condition in which the cooling action of the subcooling heat-exchanger increases the coefficient of performance of the refrigeration cycle device 1 greater than the cooling action of the sub-refrigerant-circuit is prescribed as the second switching condition. As the state quantities for determining whether the second switching condition is satisfied, similarly to the first switching condition, the outside air temperature Ta, the temperature Th1 of the main refrigerant at the main heat-source-side heat exchanger 25, the subcooling degree SCh1 of the main refrigerant at the outlet of the subcooling heat exchanger 62, or the subcooling degree SCh2 of the main refrigerant at the outlet of the sub-use-side heat exchanger 85 is used.

In Step ST4, when the outside air temperature Ta is less than or equal to a third temperature Tat2, when the temperature Th1 is less than or equal to a fourth temperature Th1*t*2, when the subcooling degree SCh1 is greater than or equal to a third subcooling degree SCh1*t*2, or when the subcooling degree SCh2 is greater than or equal to a fourth subcooling degree SCh2*t*2, the control unit 9 determines that the second switching condition is satisfied. That is, it is determined that, by performing the cooling action of the subcooling heat-exchanger, the enthalpy of the main refrigerant that is sent to the main use-side heat exchangers 72*a* and 72*b* is sufficiently reduced. Here, the third temperature Tat2 and the fourth temperature Th1*t*2 are set at a temperature (about 10--25° C.) that is lower than the first temperature Tat1 and the second temperature Th1*t*1, and the third subcooling degree SCh1*t*2 and the fourth subcooling degree SCh2*t*2 are set at a subcooling degree (about 10--15° C.) that is higher than the first subcooling degree SCh1*t*1 and the second subcooling degree SCh2*t*1.

In Step ST4, when the state quantities, such as the outside air temperature Ta, do not satisfy the second switching condition, the control unit 9 continues the cooling action of the sub-refrigerant-circuit of Step ST3, and when the state quantities, such as the outside air temperature Ta, satisfy the second switching condition, the control unit 9 proceeds to Step ST1 and switches from the cooling action of the sub-refrigerant-circuit to the cooling action of the subcooling heat-exchanger. That is, the control unit 9 stops the cooling action of the sub-refrigerant-circuit by stopping the sub-compressor 81, and performs the cooling action of the subcooling heat-exchanger by opening the suction injection expansion mechanism 63. Therefore, by performing the cooling action of the subcooling heat-exchanger, it is possible to sufficiently reduce the enthalpy of the main refrigerant that is sent to the main use-side heat exchangers 72*a* and 72*b*.

In this way, here, when the first switching condition, such as the outside air temperature Ta being high, is satisfied, the cooling operation accompanying the cooling action of the sub-refrigerant-circuit is performed, and, when the second switching condition, such as the outside air temperature Ta being low, is satisfied, the cooling operation accompanying the cooling action of the subcooling heat-exchanger is performed. When a condition is between the first switching condition and the second switching operation, such as the outside air temperature Ta being about an intermediate temperature, the cooling operation accompanying the cooling action of the subcooling heat-exchanger or the cooling action of the sub-refrigerant-circuit is performed.

(3) Features

Next, the features of the refrigeration cycle device 1 are described.

<A>

Here, as described above, not only are the suction injection pipe 61 and the subcooling heat exchanger 62 that are the same as those known in the art provided at the main refrigerant circuit 20 in which the main refrigerant circulates, but also the sub-refrigerant circuit 80 that differs from the main refrigerant circuit 20 and in which the sub-refrigerant circulates is provided. In addition, the sub-use-side heat exchanger 85 that is provided at the sub-refrigerant circuit 80 and that functions as an evaporator of the sub-refrigerant is provided at the main refrigerant circuit 20 so as to function as a heat exchanger that cools the main refrigerant that flows between the main expansion mechanism 27 and the main use-side heat exchangers 72*a* and 72*b*. Therefore, here, not only can the cooling action of the subcooling heat-exchanger that cools the main refrigerant that flows between the main expansion mechanism 27 and the main use-side heat exchangers 72*a* and 72*b* by using the suction injection pipe 61 and the subcooling heat exchanger 62 that are the same as those known in the art be performed, but also the cooling action of the sub-refrigerant-circuit that cools the refrigerant that flows between the main expansion mechanism 27 and the main use-side heat exchangers 72*a* and 72*b* by using the sub-refrigerant circuit 80 can be performed. In addition, here, as described above, even if the enthalpy of the main refrigerant that is sent to the main use-side heat exchangers 72*a* and 72*b* is not sufficiently reduced in the cooling action of the subcooling heat-exchanger, by switching between the cooling action of the subcooling heat-exchanger and the cooling action of the sub-refrigerant-circuit in accordance with the state quantities, such as the outside air temperature Ta, it is possible to sufficiently reduce the enthalpy of the main refrigerant that is sent to the main use-side heat exchangers 72*a* and 72*b* by the cooling action of the sub-refrigerant-circuit. Thus, it is possible to increase the evaporation capacity Qe of the main use-side heat exchangers 72*a* and 72*b*.

In this way, here, in the refrigeration cycle device 1 in which the suction injection pipe 61 and the subcooling heat exchanger 62 are provided at the refrigerant circuit 20, it is possible to increase the evaporation capacity Qe of the use-side heat exchangers 72*a* and 72*b* regardless of operating conditions.

<B>

Here, as described above, the condition of the state quantities, such as the outside air temperature Ta, (the first switching condition) for performing only the cooling action of the sub-refrigerant-circuit is prescribed. Here, when, due to, for example, an increase in the outside air temperature Ta, the enthalpy of the main refrigerant that is sent to the main use-side heat exchangers 72*a* and 72*b* becomes difficult to reduce even if the cooling action of the subcooling heat-exchanger is performed, the coefficient of performance of the refrigeration cycle device 1 tends to be reduced. In addition, when this tendency is increased, reducing the enthalpy of the main refrigerant that is sent to the main use-side heat exchangers 72*a* and 72*b* by the cooling action of the sub-refrigerant-circuit rather realizes the condition of increasing the coefficient of performance of the refrigeration cycle device 1 even when consumption energy of the sub-compressor 81 is considered. Therefore, here, the condition in which the cooling action of the sub-refrigerant-circuit increases the coefficient of performance of the refrigeration cycle device 1 greater than the cooling action of the subcooling heat-exchanger is prescribed, as described above, as the first temperature Tat1, the second temperature Th1*t*1, the first subcooling degree SCh1*t*1, or the second subcooling degree SCh2*t*1. Note that, here, the state quantities used for determining the first switching condition are prescribed as four state quantities: the outside air temperature Ta, the temperature Th1 of the main refrigerant at the main heat-source-side heat exchanger 25, the subcooling degree SCh1 of the main refrigerant at the outlet of the subcooling heat exchanger 62, or the subcooling degree SCh2 of the main refrigerant at the outlet of the sub-use-side heat exchanger 85. However, any one of these state quantities or two or three of these state quantities may be used.

Consequently, here, it is possible to switch to perform only the cooling action of the sub-refrigerant-circuit by considering the coefficient of performance of the refrigeration cycle device 1.

<C>

Here, as described above, the condition of the state quantities, such as the outside air temperature Ta, (the second switching condition) for performing only the cooling action of the subcooling heat-exchanger is prescribed. Here, when, due to, for example, a reduction in the outside air temperature Ta, the enthalpy of the main refrigerant that is sent to the main use-side heat exchangers 72*a* and 72*b* is sufficiently reduced by performing the cooling action of the subcooling heat-exchanger, the coefficient of performance of the refrigeration cycle device 1 has a tendency to increase. In addition, when this tendency is increased, reducing the enthalpy of the main refrigerant that is sent to the main use-side heat exchangers 72*a* and 72*b* by performing the cooling action of the sub-refrigerant-circuit rather realizes the condition of reducing the coefficient of performance of the refrigeration cycle device 1 when consumption energy of the sub-compressor 81 is considered. Therefore, here, the condition in which the cooling action of the subcooling heat-exchanger increases the coefficient of performance of the refrigeration cycle device 1 greater than the cooling action of the sub-refrigerant-circuit is prescribed, as described above, as the third temperature Tat2, the fourth temperature Th1*t*2, the third subcooling degree SCh1*t*2, or the fourth subcooling degree SCh2*t*2. Note that, here, the state quantities for determining the second switching condition are four state quantities: the outside air temperature Ta, the temperature Th1 of the main refrigerant at the main heat-source-side heat exchanger 25, the subcooling degree SCh1 of the main refrigerant at the outlet of the subcooling heat exchanger 62, or the subcooling degree SCh2 of the main refrigerant at the outlet of the sub-use-side heat exchanger 85. However, any one of these state quantities or two or three of these state quantities may be used.

Consequently, here, it is possible to switch to perform only the cooling action of the subcooling heat-exchanger by considering the coefficient of performance of the refrigeration cycle device 1.

<D>

In addition, here, as described above, the control unit 9 performs the cooling action of the sub-refrigerant-circuit by operating the sub-compressor 81, and stops the cooling action of the sub-refrigerant-circuit by stopping the sub-compressor 81. In addition, at the time of the cooling action of the sub-refrigerant-circuit, the control unit 9 controls the operating capacity of the sub-compressor 81.

Therefore, here, at the time of the cooling action of the sub-refrigerant-circuit, it is possible to adjust the cooling capacity of the sub-use-side heat exchanger 85 by changing the flow rate of the sub-refrigerant that circulates in the sub-refrigerant circuit 80.

<E>

In addition, here, as described above, the suction injection pipe 61 has the suction injection expansion mechanism 63. The control unit 9 performs the cooling action of the subcooling heat-exchanger by opening the suction injection expansion mechanism 63, and stops the cooling action of the subcooling heat-exchanger by closing the suction injection expansion mechanism 63. At the time of the cooling action of the subcooling heat-exchanger, the control unit 9 controls the opening degree of the suction injection expansion mechanism 63.

Therefore, here, at the time of the cooling action of the subcooling heat-exchanger, it is possible to adjust the cooling capacity of the subcooling heat exchanger 62 by changing the flow rate of the main refrigerant that flows in the suction injection pipe 63.

<F>

Here, as described above, the suction injection pipe 61 causes the main refrigerant in the liquid state that flows between the gas-liquid separator 51 and the subcooling heat exchanger 62 to branch off, and the subcooling heat exchanger 62 is provided between the gas-liquid separator 51 and the main use-side heat exchangers 72*a* and 72*b*. In addition, it is possible to cause, not only the main refrigerant that flows in the suction injection pipe 61, but also a main refrigerant that is extracted by the degassing pipe 52 from the gas-liquid separator 51 to flow to the subcooling heat exchanger 62 as a main-refrigerant cooling source. Therefore, here, at the time of the cooling action of the subcooling heat-exchanger, a main refrigerant that flows in the suction injection pipe 61 and the degassing pipe 52 is caused to flow in the subcooling heat exchanger 62 by an opening operation of the suction injection expansion mechanism 63, and, when the cooling action of the subcooling heat-exchanger is stopped, only the main refrigerant that flows in the degassing pipe 52 is caused to flow in the subcooling heat exchanger 62 by a closing operation of the suction injection expansion mechanism 63. That is, here, the cooling action of the subcooling heat-exchanger is not said to be performed when only the cooling operation that is performed at the subcooling heat exchanger 62 with only the main refrigerant that flows in the degassing pipe 52 is performed (the cooling action of the subcooling heat-exchanger is said to be stopped). The cooling action of the subcooling heat-exchanger is said to be performed when the cooling operation that is performed at the subcooling heat exchanger 62 with the main refrigerant that flows in the suction injection pipe 61 by the opening operation of the suction injection expansion mechanism 63 is performed.

In this way, here, when the cooling action of the subcooling heat-exchanger is performed and when the cooling action of the subcooling heat-exchanger is stopped, the subcooling heat exchanger 62 allows the main refrigerant in the liquid state that flows between the gas-liquid separator 51 and the main use-side heat exchangers 72*a* and 72*b* to be cooled by at least the main refrigerant that flows in the degassing pipe 52.

<G>

Here, as described above, since carbon dioxide is used as the main refrigerant, and a refrigerant having a low GWP or a natural refrigerant having a coefficient of performance that is higher than that of carbon dioxide is used as the sub-refrigerant, it is possible to reduce environmental load, such as global warming.

(4) Modifications

<Modification 1>

In the embodiment above, as described above, when a condition is between the first switching condition and the second switching operation, such as the outside air temperature Ta being about an intermediate temperature, the cooling operation accompanying the cooling action of the subcooling heat-exchanger or the cooling action of the sub-refrigerant-circuit is performed.

In contrast, here, when a condition is between the first switching condition and the second switching operation, such as the outside air temperature Ta being about an intermediate temperature, the cooling operation accompanying the cooling action of the subcooling heat-exchanger and the cooling action of the sub-refrigerant-circuit is performed.

Figure 7:
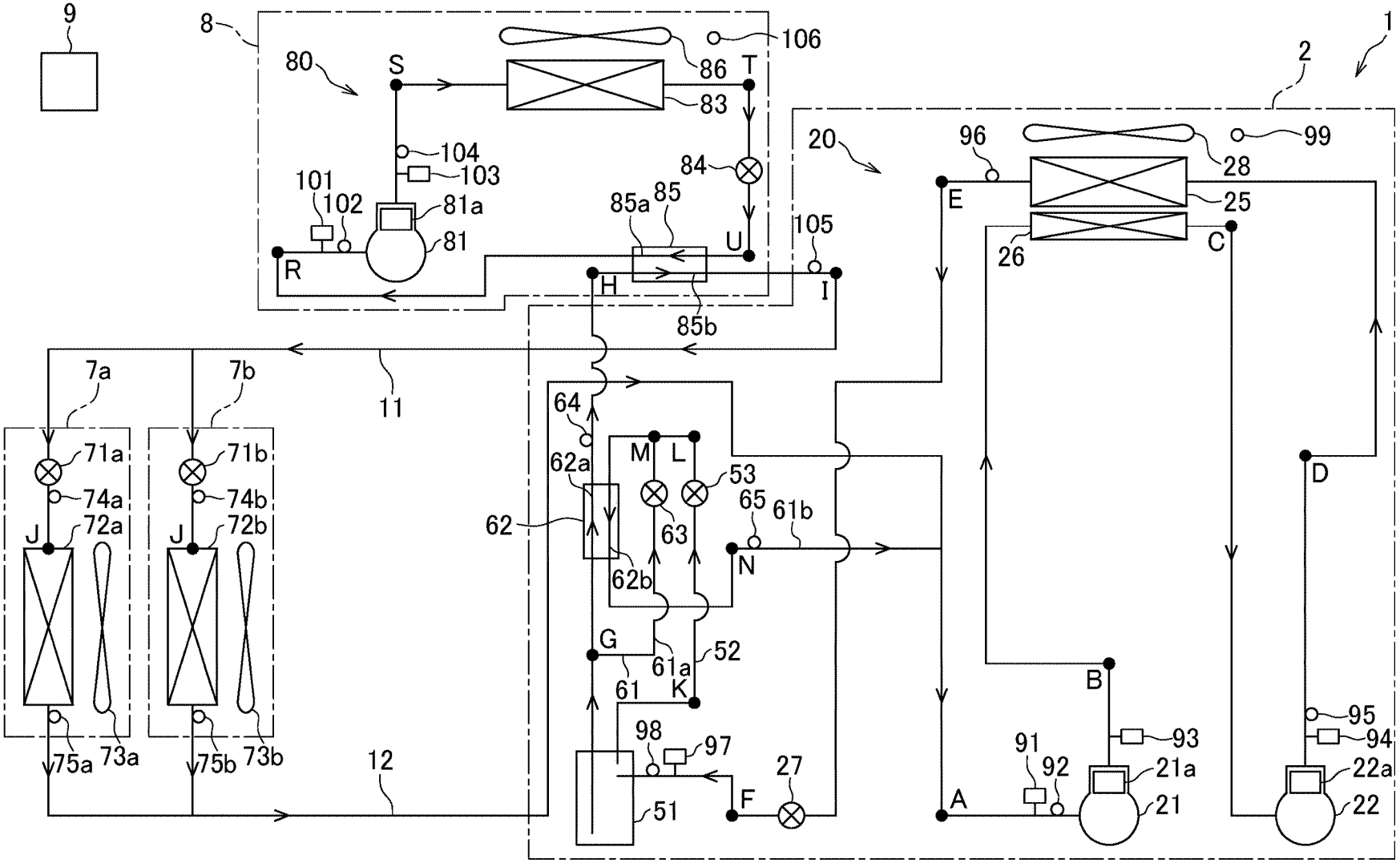
FIG. 7 illustrates flow of a refrigerant in the refrigeration cycle device at the time of a cooling operation accompanying the cooling action of the subcooling heat-exchanger and the cooling action of the sub-refrigerant-circuit in Modification 1.
Figure 8:
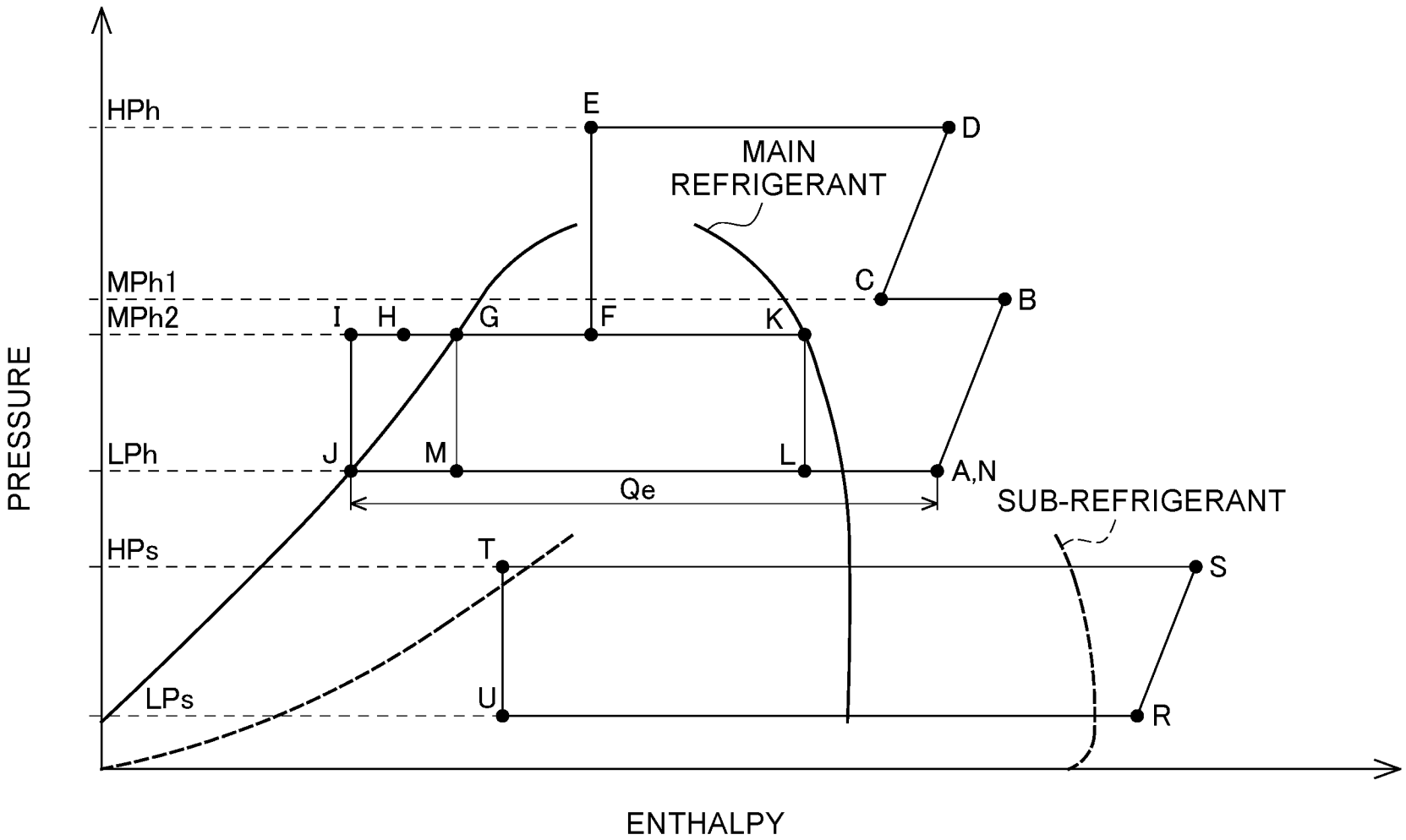
FIG. 8 is a pressure-enthalpy diagram illustrating the refrigeration cycle at the time of the cooling operation accompanying the cooling action of the subcooling heat-exchanger and the cooling action of the sub-refrigerant-circuit in Modification 1.

Here, as shown in FIGS. 7 and 8, the cooling operation accompanying the cooling action of the subcooling heat-exchanger and the cooling action of the sub-refrigerant-circuit is an operation in which, at the time of the cooling operation, the cooling action of the subcooling heat-exchanger is performed by opening the suction injection expansion mechanism 63 and the cooling action of the sub-refrigerant-circuit is performed by operating the sub-compressor 81.

By performing the cooling operation accompanying the cooling action of the subcooling heat-exchanger and the cooling action of the sub-refrigerant-circuit, the main refrigerant at the intermediate pressure (MPh2) that has been separated at the gas-liquid separator 51 (refer to point G in FIGS. 7 and 8) is cooled at the subcooling heat exchanger 62 (refer to point H in FIGS. 7 and 8) and is then cooled even at the sub-use-side heat exchanger 85 (refer to point I in FIGS. 7 and 8). At this time, at the subcooling heat exchanger 62, the cooling heat amount of the main refrigerant is larger than that when only the cooling action of the sub-refrigerant-circuit is performed (refer to the point H in FIG. 5), and the cooling heat amount of the main refrigerant is smaller than that when only the cooling action of the subcooling heat-exchanger is performed (refer to point H in FIG. 3). In addition, an insufficient cooling heat amount of the main refrigerant in the cooling action of the subcooling heat-exchanger is supplemented at the sub-use-side heat exchanger 85, and, thus, as in the cooling operation accompanying the cooling action of the subcooling heat-exchanger or the cooling action of the sub-refrigerant-circuit, the enthalpy of the refrigerant that is sent to the main use-side heat exchangers 72*a* and 72*b* is sufficiently reduced.

Note that, when the cooling operation accompanying both the cooling action of the subcooling heat-exchanger and the cooling action of the sub-refrigerant-circuit is considered, the sub-use-side heat exchanger 85 of the sub-refrigerant circuit 80 that is capable of cooling the main refrigerant to a lower temperature level than the subcooling heat exchanger 62 is desirably disposed on a downstream side with respect to the subcooling heat exchanger 62, that is, between the subcooling heat exchanger 62 and the main use-side heat exchangers 72*a* and 72*b*.

Figure 9:
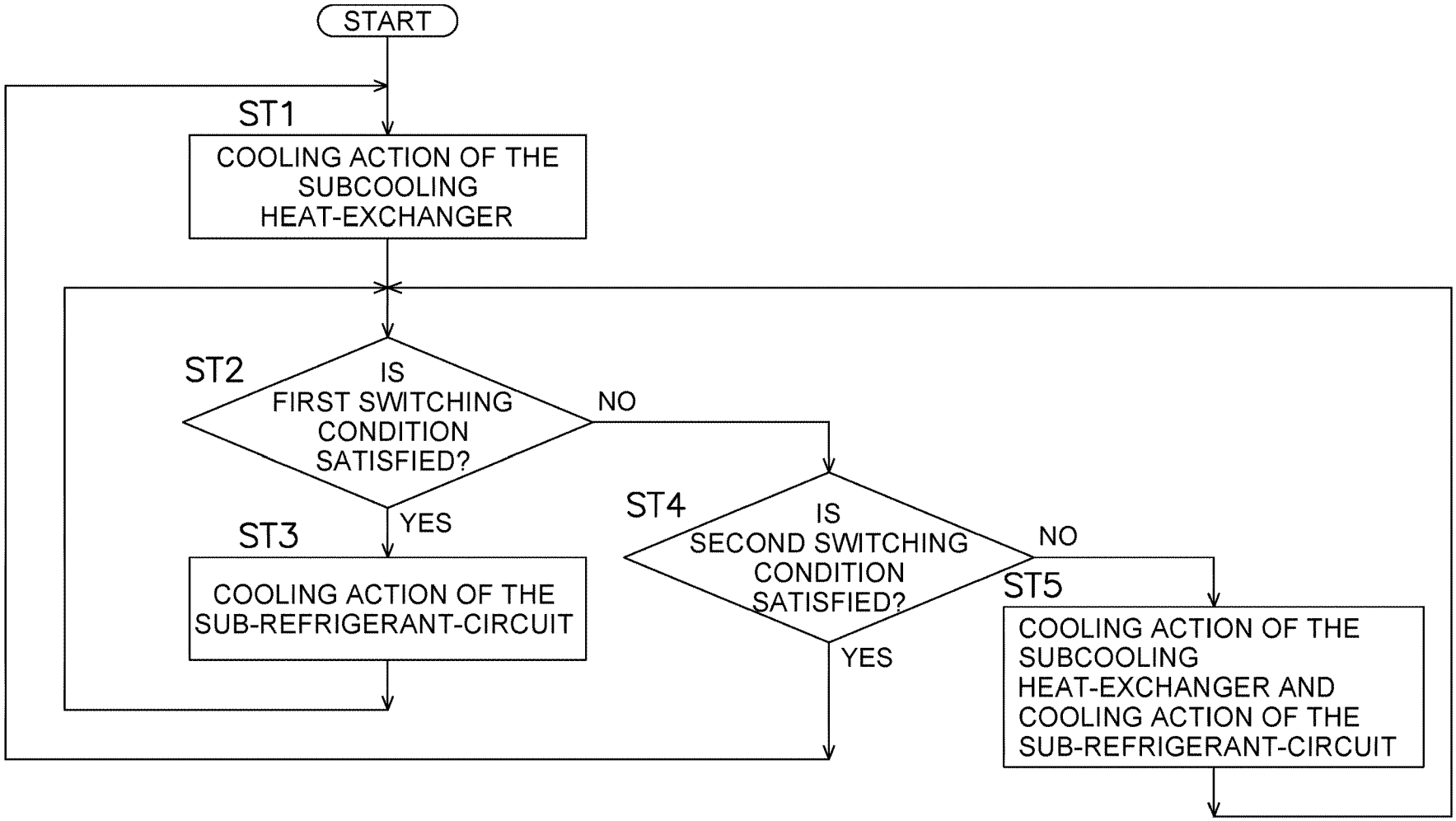
FIG. 9 is a flow chart of control for switching between the cooling action of the subcooling heat-exchanger and the cooling action of the sub-refrigerant-circuit in Modification 1.

In addition, as shown in FIG. 9, the cooling operation accompanying both the cooling action of the subcooling heat-exchanger and the cooling action of the sub-refrigerant-circuit is performed when a condition is between the first switching condition and the second switching condition, such as the outside air temperature Ta being about an intermediate temperature, that is, when both the first switching condition and the second switching condition are not satisfied. Specifically, in switching between the operations in the embodiment above (refer to FIG. 6), the cooling action of the subcooling heat-exchanger is continued when the first switching condition is not satisfied in Step ST2, and the cooling action of the sub-refrigerant-circuit is continued when the second switching condition is not satisfied in Step ST4. In contrast, in the present modification, when the first switching condition is not satisfied in Step ST2 and when the second switching condition is not satisfied in Step ST4, both the cooling action of the subcooling heat-exchanger and the cooling action of the sub-refrigerant-circuit are performed in Step ST5.

<Modification 2>

Figure 10:
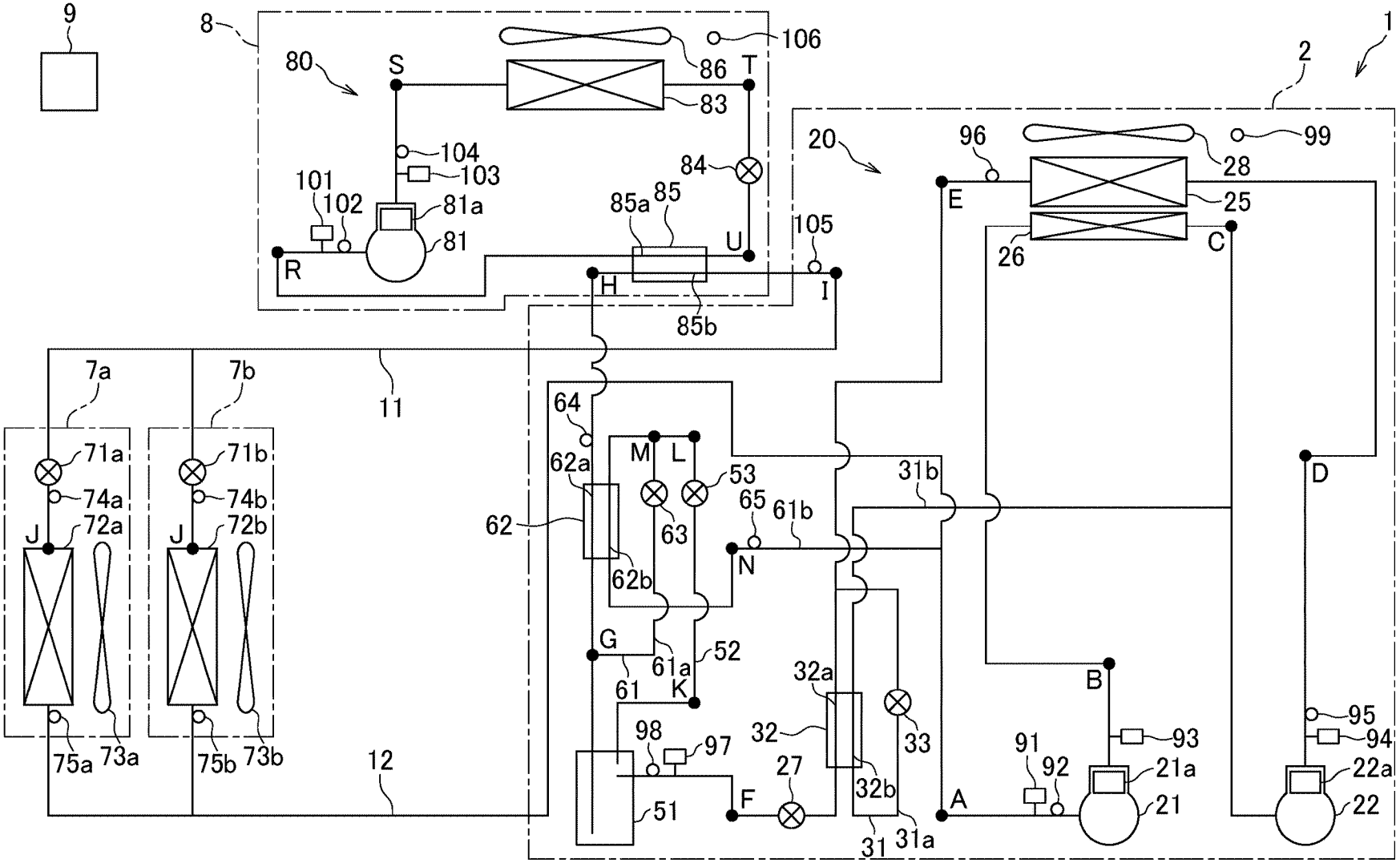
FIG. 10 is a schematic view of a configuration of a refrigeration cycle device of Modification 2.

In the embodiment and Modification 1 above, as shown in FIG. 10, an intermediate injection pipe 31 and an economizer heat exchanger 32 may be provided between the main heat-source-side heat exchanger 25 and the main expansion mechanism 27.

Specifically, the intermediate injection pipe 31 is a refrigerant pipe in which the main refrigerant flows, and, here, is a refrigerant pipe that causes the main refrigerant that flows between the main heat-source-side heat exchanger 25 and the main use-side heat exchangers 72*a* and 72*b* to branch off and to be sent to the main compressors 21 and 22. Specifically, the intermediate injection pipe 31 is a refrigerant pipe that causes the main refrigerant that flows between the main heat-source-side heat exchanger 25 and the main expansion mechanism 27 to branch off and to be sent to the suction side of the second main compressor 22, and includes a first intermediate injection pipe 31*a* and a second intermediate injection pipe 31*b*. One end of the first intermediation injection pipe 31*a* is connected at a location between the other end of the main heat-source-side heat exchanger 25 and the economizer heat exchanger 32 (one end of a first economizer flow path 32*a*), and the other end of the first intermediate injection pipe 31*a* is connected to the economizer heat exchanger 32 (one end of a second economizer flow path 32*b*). One end of the second intermediate injection pipe 31*b* is connected to the economizer heat exchanger 32 (the other end of the second economizer flow path 32*b*), and the other end of the second intermediate injection pipe 31*b* is connected at a location between an outlet of the intermediate heat exchanger 26 and the suction side of the second main compressor 22.

The intermediate injection pipe 31 has an intermediate injection expansion mechanism 33. The intermediate injection expansion mechanism 33 is provided at the first intermediate injection pipe 31*a*. The intermediate injection expansion mechanism 33 is a device that decompresses the main refrigerant, and, here, is an expansion mechanism that decompresses a main refrigerant that flows in the intermediate injection pipe 31. The intermediate injection expansion mechanism 33 is, for example, an electrically powered expansion valve.

The economizer heat exchanger 32 is a device that causes main refrigerants to exchange heat with each other, and, here, is a heat exchanger that cools a main refrigerant that flows between the main heat-source-side heat exchanger 25 and the main use-side heat exchangers 72*a* and 72*b* by heat exchange with the main refrigerant that flows in the intermediate injection pipe 31. Specifically, the economizer heat exchanger 32 is a heat exchanger that cools a main refrigerant that flows between the main heat-source-side heat exchanger 25 and the main expansion mechanism 27 by heat exchange with the main refrigerant that flows in the intermediate injection pipe 31. The economizer heat exchanger 32 has the first economizer flow path 32*a* in which the main refrigerant that flows between the main heat-source-side heat exchanger 25 and the main expansion mechanism 27 is caused to flow, and the second economizer flow path 32*b* in which the main refrigerant that flows in the intermediate injection pipe 31 is caused to flow. The one end (inlet) of the first economizer flow path 32*a* is connected to the other end of the main heat-source-side heat exchanger 25, and the other end (outlet) of the first economizer flow path 32*a* is connected to an inlet of the main expansion mechanism 27. The one end (inlet) of the second economizer flow path 32*b* is connected to the other end of the first intermediate injection pipe 31*a*, and the other end (outlet) of the second economizer flow path 32*b* is connected to the one end of the second intermediate injection pipe 31*b*.

At the time of the cooling operation, the control unit 9 performs control for opening the intermediate injection expansion mechanism 33 to further cool the main refrigerant that has dissipated heat at the main heat-source-side heat exchanger 25, and is capable of sending the main refrigerant to a compression stroke in midstream of the main compressor 21 or 22 (here, to the suction side of the second main compressor 22) and cooling the main refrigerant that is sucked by the second main compressor 22.

Even in this case, similarly to the embodiment and Modification 1 above, it is possible to switch between the cooling action of the subcooling heat-exchanger and the cooling action of the sub-refrigerant-circuit.

<Modification 3>

Figure 11:
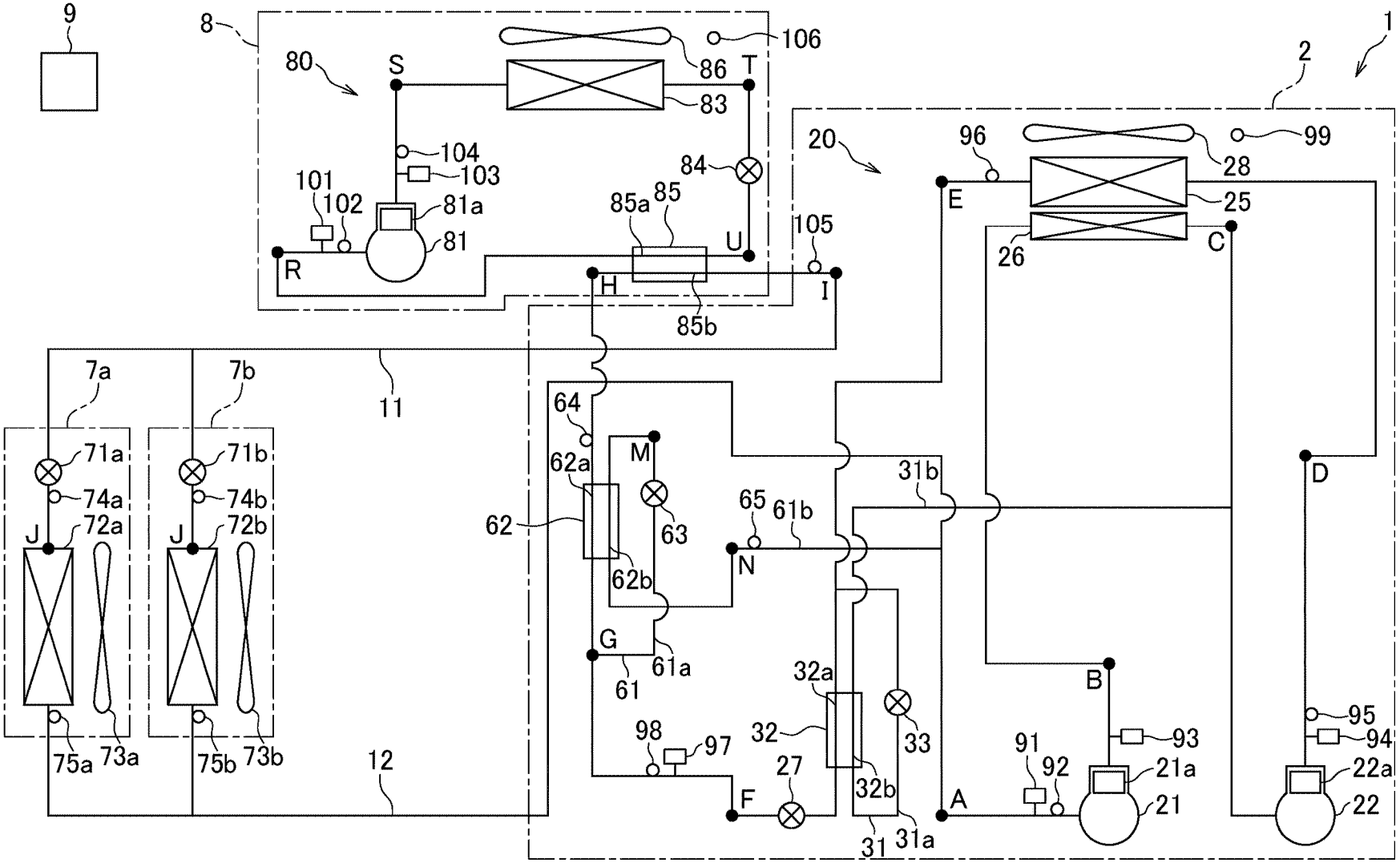
FIG. 11 is a schematic view of a configuration of a refrigeration cycle device of Modification 3.

In the embodiment and Modifications 1 and 2 above, as shown in FIG. 11, the gas-liquid separator 51 and the degassing pipe 52 may be left out.

Even in this case, similarly to the embodiment and Modifications 1 and 2 above, it is possible to switch between the cooling action of the subcooling heat-exchanger and the cooling action of the sub-refrigerant-circuit.

However, in this case, in the cooling action of the subcooling heat-exchanger, when the suction injection expansion mechanism 63 is opened, only the main refrigerant that flows in the suction injection pipe 61 flows in the second subcooling flow path 62*b* of the subcooling heat exchanger 62. In addition, in the cooling action of the sub-refrigerant-circuit, when the suction injection expansion mechanism 63 is closed, the main refrigerant no longer flows in the suction injection pipe 61. Therefore, at the subcooling heat exchanger 62, heat is no longer exchanged between the main refrigerants.

<Modification 4>

Although, in the embodiment and Modifications 1 to 3 above, the intermediate heat exchanger 26 that cools the main refrigerant is provided between the first main compressor 21 and the second main compressor 22, it is not limited thereto. It is possible not to provide the intermediate heat exchanger 26.

<Modification 5>

Although, in the embodiment and Modifications 1 to 4 above, the multi-stage compressor is constituted by the plurality of main compressors 21 and 22, it is not limited thereto. The multi-stage compressor may be constituted by one main compressor including the compression elements 21*a* and 21*b*.

Alternatively, a single-stage compressor may be used for the main compressor. In this case, when intermediate-pressure injection is performed as in Modification 2, the intermediate injection pipe 31 is to be connected to an intermediate injection port of the single-stage compressor.

<Modification 6>

Although the embodiment and Modifications 1 to 5 above are described by taking as an example a circuit configuration that performs a cooling operation, it is not limited thereto. A circuit configuration that is capable of performing a cooling operation and a heating operation may be used.

Although the embodiment of the present disclosure is described above, it is to be understood that various changes can be made in the forms and details without departing from the spirit and the scope of the present disclosure described in the claims.

INDUSTRIAL APPLICABILITY

The present disclosure is widely applicable to a refrigeration cycle device in which a suction injection pipe and a subcooling heat exchanger are provided at a refrigerant circuit having a compressor, a heat-source-side heat exchanger, an expansion mechanism, and a use-side heat exchanger, the suction injection pipe causing a refrigerant that flows between the heat-source-side heat exchanger and the use-side heat exchanger to branch off and to be sent to a suction side of the compressor, the subcooling heat exchanger cooling a refrigerant that flows between the expansion mechanism and the use-side heat exchanger by heat exchange with a refrigerant that flows in the suction injection pipe.

REFERENCE SIGNS LIST

1 refrigeration cycle device
9 control unit
20 main refrigerant circuit
21, 22 main compressor
25 main heat-source-side heat exchanger
27 main expansion mechanism
51 gas-liquid separator
52 degassing pipe
61 suction injection pipe
62 subcooling heat exchanger
63 suction injection expansion mechanism
72*a*, 72*b* main use-side heat exchanger
80 sub-refrigerant circuit
81 sub-compressor
83 sub-heat-source-side heat exchanger
85 sub-use-side heat exchanger

CITATION LIST

Patent Literature

Patent Literature 1

Japanese Unexamined Patent Application Publication No. 2013-139938

The invention claimed is:

1. A refrigeration cycle device comprising:

a main refrigerant circuit having a main compressor that compresses a main refrigerant, a main heat-source-side heat exchanger that functions as a radiator of the main refrigerant, a main use-side heat exchanger that functions as an evaporator of the main refrigerant, a main expansion valve that decompresses the main refrigerant that flows between the main heat-source-side heat exchanger and the main use-side heat exchanger, a suction injection pipe that causes the main refrigerant that flows between the main heat-source-side heat exchanger and the main use-side heat exchanger to branch off and to be sent to a suction side of the main compressor, and a subcooling heat exchanger that cools the main refrigerant that flows between the main expansion valve and the main use-side heat exchanger by heat exchange with the main refrigerant that flows in the suction injection pipe, wherein the main refrigerant circuit has a sub-use-side heat exchanger that functions as a cooler of the main refrigerant that flows between the main expansion valve and the main use-side heat exchanger;

the refrigeration cycle device further comprising:

a sub-refrigerant circuit having a sub-compressor that compresses a sub-refrigerant, a sub-heat-source-side heat exchanger that functions as a radiator of the sub-refrigerant, and the sub-use-side heat exchanger that functions as an evaporator of the sub-refrigerant and that cools the main refrigerant that flows between the main expansion valve and the main use-side heat exchanger; and the refrigeration cycle device further comprising:

a controller that controls constituent devices of the main refrigerant circuit and the sub-refrigerant circuit, wherein the controller determines, based on a detection signal from a sensor for outside air temperature, a detection signal from a sensor for temperature of the main refrigerant at the main heat-source-side heat exchanger, a detection signal from a sensor for subcooling degree of the main refrigerant at an outlet of the subcooling heat exchanger, or a detection signal from a sensor for subcooling degree of the main refrigerant at an outlet of the sub-use-side heat exchanger, whether a first switching condition or a second switching condition is satisfied, wherein, the controller is configured to switch between a cooling action of the subcooling heat-exchanger, which cools the main refrigerant by using the suction injection pipe and the subcooling heat exchanger and a cooling action of the sub-refrigerant-circuit, which cools the main refrigerant by using the sub-refrigerant circuit, based on whether the first switching condition or the second switching condition is satisfied.

2. The refrigeration cycle device according to claim 1, wherein, when the detection signal for outside air temperature is greater than or equal to a first temperature, when the detection signal for temperature of the main refrigerant at the main heat-source-side heat exchanger is greater than or equal to a second temperature, when the detection signal for subcooling degree of the main refrigerant at the outlet of the subcooling heat exchanger is less than or equal to a first subcooling degree, or when the detection signal for subcooling degree of the main refrigerant at the outlet of the sub-use-side heat exchanger is less than or equal to a second subcooling degree, the controller determines that the first switching condition has been satisfied and switches to perform the cooling action of the sub-refrigerant-circuit.

3. The refrigeration cycle device according to claim 1, wherein, when the detection signal for outside air temperature is less than or equal to a first temperature, when the detection signal for temperature of the main refrigerant at the main heat-source-side heat exchanger is less than or equal to a second temperature, when the detection signal for subcooling degree of the main refrigerant at the outlet of the subcooling heat exchanger is greater than or equal to a first subcooling degree, or when the detection signal for subcooling degree of the main refrigerant at the outlet of the sub-use-side heat exchanger is greater than or equal to a second subcooling degree, the controller determines that the second switching condition has been satisfied and switches to perform the cooling action of the subcooling heat-exchanger.

4. The refrigeration cycle device according to claim 1, wherein the controller performs the cooling action of the sub-refrigerant-circuit by operating the sub compressor, and stops the cooling action of the sub-refrigerant-circuit by stopping the sub-compressor.

5. The refrigeration cycle device according to claim 4, wherein, at a time of the cooling action of the sub-refrigerant-circuit, the controller controls an operating capacity of the sub-compressor.

6. The refrigeration cycle device according to claim 1, wherein the suction injection pipe has a suction injection expansion valve, and the controller performs the cooling action of the subcooling heat-exchanger by opening the suction injection expansion valve, and stops the cooling action of the subcooling heat-exchanger by closing the suction injection expansion valve.

7. The refrigeration cycle device according to claim 6, wherein, at a time of the cooling action of the subcooling heat-exchanger, the controller controls an opening degree of the suction injection expansion valve.

8. The refrigeration cycle device according to claim 6, wherein the main refrigerant circuit has a gas-liquid separator between the main expansion valve and the subcooling heat exchanger, the gas-liquid separator causing the main refrigerant decompressed at the main expansion valve to undergo a gas-liquid separation, a degassing pipe that extracts the main refrigerant in a gas state and sends the main refrigerant in the gas state to the suction side of the main compressor is connected to the gas-liquid separator, the suction injection pipe is provided at the main refrigerant circuit so that the main refrigerant in a liquid state that flows between the gas-liquid separator and the subcooling heat exchanger branches off, and the subcooling heat exchanger is provided at the main refrigerant circuit so that the main refrigerant in the liquid state that flows between the gas-liquid separator and the main use-side heat exchanger is cooled by heat exchange with the main refrigerant that flows in the suction injection pipe and the main refrigerant that flows in the degassing pipe.

9. The refrigeration cycle device according to claim 1, wherein the main refrigerant is carbon dioxide, and the sub-refrigerant is a HFC refrigerant having a GWP that is 750 or less, a HFO refrigerant having a GWP that is 750 or less, or a mixture refrigerant having a CANT that is 750 or less in which the HFC refrigerant and the HFO refrigerant are mixed.

10. The refrigeration cycle device according to claim 1, wherein the main refrigerant is carbon dioxide, and the sub-refrigerant is a natural refrigerant having a coefficient of performance that is higher than a coefficient of performance of the carbon dioxide.

11. The refrigeration cycle device according to claim 2, wherein, when the outside air temperature is less than or equal to a third temperature, when the temperature of the main refrigerant at the main heat-source-side heat exchanger is less than or equal to a fourth temperature, when the subcooling degree of the main refrigerant at the outlet of the subcooling heat exchanger is greater than or equal to a third subcooling degree, or when the subcooling degree of the main refrigerant at the outlet of the sub-use-side heat exchanger is greater than or equal to a fourth subcooling degree, the controller determines that the second switching condition is satisfied and switches to perform the cooling action of the subcooling heat-exchanger.

12. The refrigeration cycle device according to claim 2, wherein the controller performs the cooling action of the sub-refrigerant-circuit by operating the sub-compressor, and stops the cooling action of the sub-refrigerant-circuit by stopping the sub-compressor.

13. The refrigeration cycle device according to claim 3, wherein the controller performs the cooling action of the sub-refrigerant-circuit by operating the sub-compressor, and stops the cooling, action of the sub-refrigerant-circuit by stopping the sub-compressor.

14. The refrigeration cycle device according to claim 2, wherein the suction injection pipe has a suction injection expansion valve, and the controller performs the cooling action of the subcooling heat-exchanger by opening the suction injection expansion valve, and stops the cooling action of the subcooling heat-exchanger by closing the suction injection expansion valve.

15. The refrigeration cycle device according to claim 3, wherein the suction injection pipe has a suction injection expansion valve, and the controller performs the cooling action of the subcooling heat-exchanger by opening the suction injection expansion valve, and stops the cooling action of the subcooling heat-exchanger by closing the suction injection expansion valve.

16. The refrigeration cycle device according to claim 4, wherein the suction injection pipe has a suction injection expansion valve, and the controller performs the cooling action of the subcooling heat-exchanger by opening the suction injection expansion valve, and stops the cooling action of the subcooling heat-exchanger by closing the suction injection expansion valve.

17. The refrigeration cycle device according to claim 5, wherein the suction injection pipe has a suction injection expansion valve, and the controller performs the cooling action of the subcooling heat-exchanger by opening the suction injection expansion valve, and stops the cooling action of the subcooling heat-exchanger by closing the suction injection expansion valve.

18. The refrigeration cycle device according to claim 7, wherein the main refrigerant circuit has a gas-liquid separator between the main expansion valve and the subcooling heat exchanger, the gas-liquid separator causing the main refrigerant decompressed at the main expansion valve to undergo a gas-liquid separation, a degassing pipe that extracts the main refrigerant in a gas state and sends the main refrigerant in the gas state to the suction side of the main compressor is connected to the gas-liquid separator, the suction injection pipe is provided at the main refrigerant circuit so that the main refrigerant in a liquid state that flows between the gas-liquid separator and the subcooling heat exchanger branches off, and the subcooling heat exchanger is provided at the main refrigerant circuit so that the main refrigerant in the liquid state that flows between the gas-liquid separator and the main use-side heat exchanger is cooled by heat exchange with the main refrigerant that flows in the suction injection pipe and the main refrigerant that flows in the degassing pipe.

19. The refrigeration cycle device according to claim 2, wherein the main refrigerant is carbon dioxide, and the sub-refrigerant is a HFC refrigerant having a GWP that is 750 or less, a HFO refrigerant having a GWP that is 750 or less, or a mixture refrigerant having a GWP that is 750 or less in which the HFC refrigerant and the FIFO refrigerant are mixed.

20. The refrigeration cycle device according to claim 3, wherein the main refrigerant is carbon dioxide, and the sub-refrigerant is a HFC refrigerant having a GWP that is 750 or less, a HFO refrigerant having a GWP that is 750 or less, or a mixture refrigerant having a GWP that is 750 or less in which the HFC refrigerant and the HFO refrigerant are mixed.

* * * * *